US007478975B2

(12) United States Patent
Hubbard et al.

(10) Patent No.: US 7,478,975 B2
(45) Date of Patent: Jan. 20, 2009

(54) APPARATUS FOR CRYOGENIC FLUIDS HAVING FLOATING LIQUEFACTION UNIT AND FLOATING REGASIFICATION UNIT CONNECTED BY SHUTTLE VESSEL, AND CRYOGENIC FLUID METHODS

(75) Inventors: Bradford Scott Hubbard, Katy, TX (US); Ned Baudat, New Braunfels, TX (US); W. Scott Worthington, Brookshire, TX (US)

(73) Assignee: Wood Group Advanced Parts Manufacture A.G., Neunhof (CH)

( * ) Notice: Subject to any disclaimer, the term of this patent is extended or adjusted under 35 U.S.C. 154(b) by 0 days.

(21) Appl. No.: 11/609,321

(22) Filed: Dec. 11, 2006

(65) Prior Publication Data

US 2007/0186564 A1 Aug. 16, 2007

Related U.S. Application Data

(63) Continuation-in-part of application No. 10/971,767, filed on Oct. 21, 2004, now Pat. No. 7,318,319, which is a continuation-in-part of application No. 10/894,355, filed on Jul. 18, 2004, now abandoned.

(51) Int. Cl.
*F17C 9/02* (2006.01)

(52) U.S. Cl. ..... 405/210; 62/50.2; 62/613; 405/219

(58) Field of Classification Search ..... 62/611, 62/50.2, 53.2; 141/387, 388, 82; 405/210, 405/219

See application file for complete search history.

(56) References Cited

U.S. PATENT DOCUMENTS

| | | | | |
|---|---|---|---|---|
| 4,202,648 | A * | 5/1980 | Kvamsdal | 405/210 |
| 4,217,848 | A * | 8/1980 | Meyer-Haake | 114/264 |
| 6,089,022 | A * | 7/2000 | Zednik et al. | 60/641.7 |
| 2007/0186564 | A1 * | 8/2007 | Hubbard et al. | 62/50.2 |

* cited by examiner

*Primary Examiner*—Tara L. Mayo
(74) *Attorney, Agent, or Firm*—J. M. (Mark) Gilbreath; Mary A. Gilbreath; Gilbreath & Associates, P.C.

(57) ABSTRACT

Methods and systems for transportation and processing of a cryogenic fluid. The system includes a floating liquefaction unit receiving a gas from a source, a shuttle vessel for carrying liquefied gas away from the liquefaction unit, a floating regasification unit for receiving the liquefied gas from the vessel, regasifying the liquefied gas and providing the gas to a distribution system.

5 Claims, 14 Drawing Sheets

Fig. 3
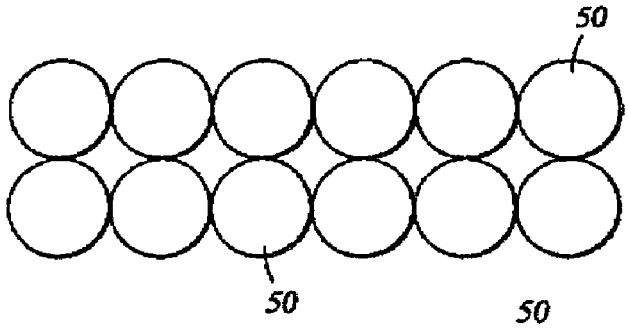
Fig. 4
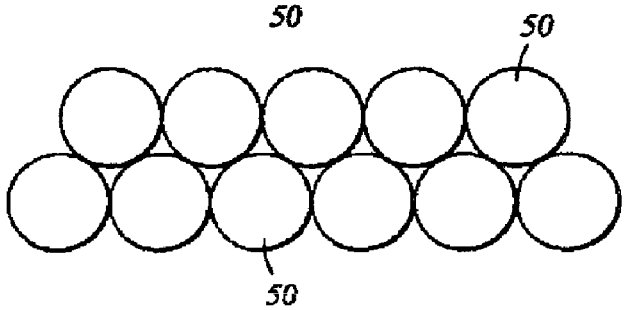
Fig. 5
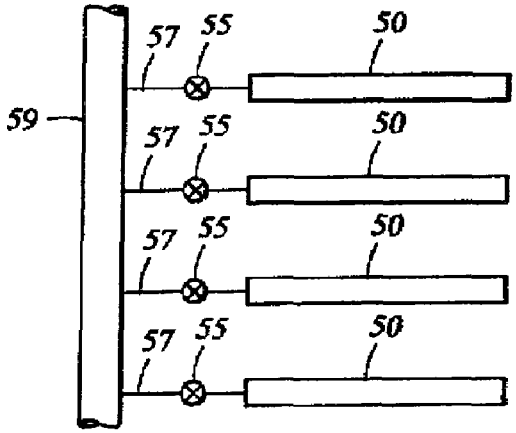
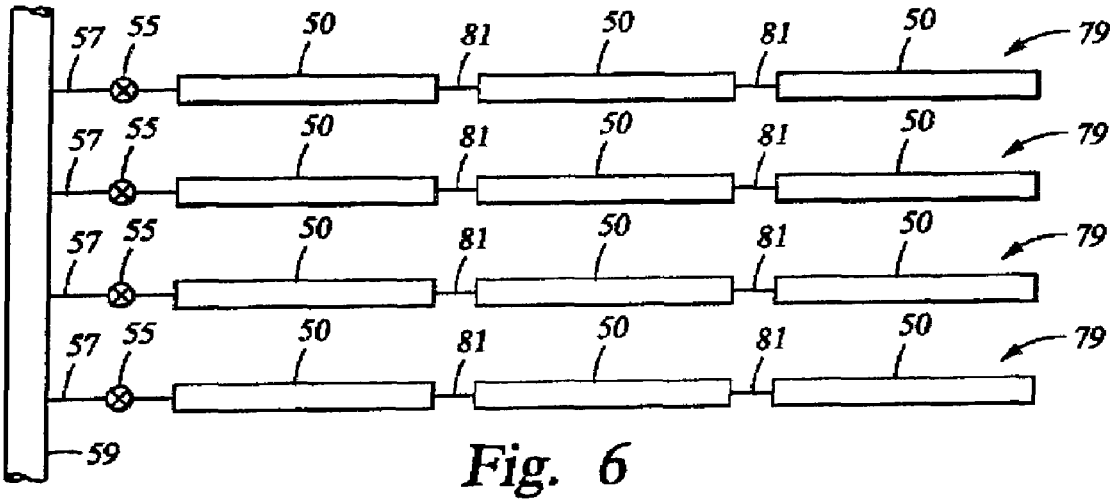
Fig. 6

260
134
160
109
439
438
436
108
435
107
411
414
413
433
432
431
125
220
408
142
429
428
409
406
124
105
423
416
139
157
425
141
122
138
156
155
137
51F
404
422
421
135
153
152
132
151
419
417
131
240
403
103
1100
95°F

APPARATUS FOR CRYOGENIC FLUIDS HAVING FLOATING LIQUEFACTION UNIT AND FLOATING REGASIFICATION UNIT CONNECTED BY SHUTTLE VESSEL, AND CRYOGENIC FLUID METHODS

RELATED APPLICATION DATA

This application is a continuation-in-part of U.S. patent application Ser. No. 10/971,767 filed Oct. 21, 2004, now U.S. Pat. No. 7,318,319; which is a continuation-in-part of U.S. patent application Ser. No. 10/894,355 filed Jul. 18, 2004, now abandoned; each of which is herein incorporated by reference. The present application is also a continuation-in-part of each U.S. patent application Ser. Nos. 10/869,461 filed Jun. 15, 2004, now U.S. Pat. No. 7,155,917; Ser. No. 10/816,793 filed Apr. 1, 2004, now U.S. Pat. No. 7,225,636; and Ser. No. 10/782,736 filed Feb. 19, 2004, now U.S. Pat. No. 7,146,817; each of which is herein incorporated by reference.

BACKGROUND OF THE INVENTION

1. Field of the Invention

The present invention relates to cryogenic fluids. In another aspect, the present invention relates to methods and apparatus for processing, transporting and/or storing cryogenic fluids. In even another aspect, the present invention relates to receiving and/or dispensing terminals for cryogenic fluids and to methods of receiving, dispensing and/or storing cryogenic fluids. In still another aspect, the present invention relates a cryogenic fluid system having a floating liquefaction unit receiving a gas from a source, a shuttle vessel for carrying liquefied gas away from the liquefaction unit, and a floating regasification unit for receiving the liquefied gas from the vessel, regasifying the liquefied gas and providing the gas to a distribution system.

2. Description of the Related Art

Most conveniently, natural gas is transported from the location where it is produced to the location where it is consumed by a pipeline. However, given certain barriers of geography, economics, and/or politics, transportation by pipeline is not always possible, economic or permitted. Without an effective way to transport the natural gas to a location where there is a commercial demand, the gas may be burned as it is produced, which is wasteful or reinjected into a subsurface reservoir which is costly and defers the utilization of the gas.

Liquefaction of the natural gas facilitates storage and transportation of the natural gas (a mixture of hydrocarbons, typically 65 to 99 percent methane, with smaller amounts of ethane, propane and butane). When natural gas is chilled to below its boiling point (in the neighborhood of −260° F. depending upon the composition) it becomes an odorless, colorless liquid having a volume which is less than one six hundredth (1/600) of its volume at ambient atmospheric surface temperature and pressure. Thus, it will be appreciated that a 50,000 cubic meter LNG tanker ship is capable of carrying the equivalent of 1.1 billion cubic feet of natural gas.

When LNG is warmed above its boiling point, it boils reverting back to its gaseous form.

The growing demand for natural gas has stimulated the transportation of LNG by special tanker ships. Natural gas produced in remote locations, such as Algeria, Malaysia, Brunei, or Indonesia, may be liquefied and shipped overseas in this manner to Europe, Japan, United States, or neighboring countries needing gas. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. If regasified, the resulting natural gas then may be distributed through a pipeline system to various locations where it is consumed.

Of the known liquid energy gases, liquid natural gas is the most difficult to handle because it is so intensely cold. Complex handling, shipping and storage apparatus and procedures are required to prevent unwanted thermal rise in the LNG with resultant regasification. Storage vessels, whether part of LNG tanker ships or land-based, are closely analogous to giant thermos bottles with outer walls, inner walls and effective types and amounts of insulation in between.

There still exists a need in the art for apparatus and methods for processing, transporting, and/or storing LNG.

This and other needs in the art will become apparent to those of skill in the art upon review of this specification, including its drawings and claims.

SUMMARY OF THE INVENTION

It is an object of the present invention to provide for improved apparatus and methods for processing, transporting, and/or storing LNG.

According to one embodiment of the present invention, there is provided an apparatus for transporting a gas. The apparatus includes a floating liquifaction unit having a first docking system. The apparatus also includes a floating regasification unit having a second docking system. The apparatus also includes a shuttle vessel comprising a third docking system. The shuttle vessel may be docked with the liquifaction unit, docked with the gassification unit, or traveling between the liquifaction unit and the regassification unit. The third docking system is connectable with the first docking system when the vessel is docked with the liquifaction unit, and connectable with the second docking system when the vessel is docked with the gassification unit. As further embodiments of this embodiment, the floating liquifaction unit may be connected to a gas source, and the floating regasification unit is connected to a gas distribution system. As even further embodiments, the liquifaction unit, the gassification unit, and the vessel are all floating on a body of water. As still further embodiments, there are provided methods of operating such an apparatus, and methods of transporting a gas.

According to another embodiment of the present invention, there is provided a method of transporting a gas. The method includes receiving the gas into a floating liquifaction unit. The method further includes liquifying the gas to form a liquified gas. The method further includes transferring the liquified gas from the liquifaction unit into a marine vessel. The method further includes transferring the liquified gas from the marine vessel into a floating regassification unit. The method further includes regasifying the liquified gas into a regasified gas. The method may also include providing the regasified gas to a distribution system.

According to even another embodiment of the present invention, there is provided a floating liquifaction unit, methods of operating such a unit, and methods of liquifaction.

According to still another embodiment of the present invention, there is provided a floating regassification unit, methods of operating such a unit, and methods of regassification.

These and other embodiments of the present invention will become apparent to those of skill in the art upon review of this specification, including its drawings and claims.

According to even still other embodiments of the present invention, various methods of processing, storing, transporting, and vaporizing LNG are provided as described herein.

These and other embodiments of the present invention will become apparent to those of skill in the art upon review of this specification, including its drawings and claims.

BRIEF DESCRIPTION OF THE DRAWINGS

For detailed understanding of the illustrative embodiments, reference should be made to the following detailed description, taken in conjunction with the accompanying drawings, in which like elements have been given like numerals, wherein:

FIG. 3 shows a non-limiting example of a tank arrangement, in which the tanks are arranged in a first (bottom) layer of 6 tanks parallel to each other, and in a second (top) layer of 6 tanks aligned directly on top of the bottom layer;

FIG. 4 shows a non-limiting example of a tank arrangement, in which the tanks are arranged in a first (bottom) layer of 6 tanks parallel to each other, and in a second (top) layer of 5 tanks parallel to each other, with the tanks of the top layer offset from tanks of the bottom layer by the radius of the tanks;

FIG. 5 shows tanks 50 connected to the manifold in a parallel arrangement;

FIG. 6 shows tanks 50 in which each group of tanks comprises a linear arrangement of tanks, with each group of tanks connected in parallel to header;

DETAILED DESCRIPTION

While some descriptions of the present invention may make reference to natural gas and to liquefied natural gas ("LNG"), it should be understood that the present invention is not limited to utility with natural gas and LNG, but rather has broad utility with gases and cryogenic fluids in general, preferably cryogenic fluids formed from flammable gases.

The apparatus of the present invention will find utility for processing, storing, and/or transporting (i.e., including but not limited to, receiving, dispensing, distributing, moving) gases and cryogenic fluids, a non-limiting example of which are natural gas and liquefied natural gas ("LNG").

According to the present invention, there are provided a system comprising a floating liquefaction unit, a floating regasification unit, a shuttle vessel traveling therebetween, a system for storing cryogenic fluids, and an apparatus and method for processing hydrocarbons to produce LNG.

Floating Systems with Shuttle Vessel

Figure 7:
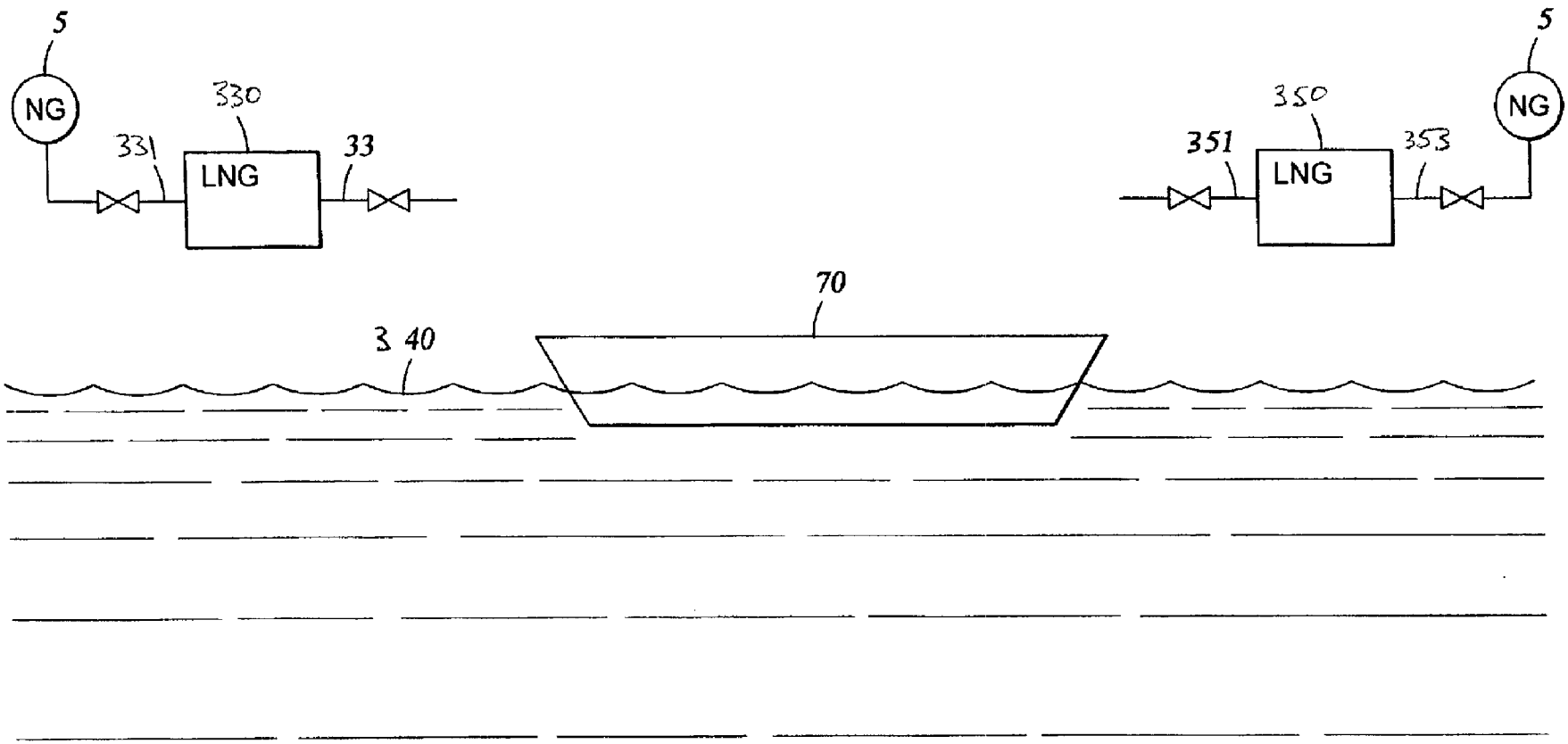
FIG. 7 is a schematic representation of natural gas transportation system, showing floating liquefaction unit, floating regasification unit, and shuttle vessel traveling therebetween.

Referring now to FIG. 7, there is shown a schematic representation of natural gas transportation system 100, showing floating liquefaction unit 330, floating regasification unit 350, and shuttle vessel 70 traveling therebetween.

Floating liquefaction unit 330 is positioned on a body of water 340 and may be permanently or periodically connected via connection 331 to a source of natural gas 5. This source of natural gas 5 may be a direct pipeline connection to natural gas being produced from a well(s), mobile a mobile vessel(s), or to storage tanks. Periodic connections could also be made to land or marine transport vessels carrying storage tanks of natural gas.

Natural gas liquefaction units are well known in the art. In the present invention, floating liquefaction unit 330 will generally include all of the necessary components of a natural gas liquefaction unit as are know to those of skill in the art. Optionally, floating liquefaction unit 330 may include storage tanks for the incoming natural gas. As for storage tanks for the LNG, they may be provided, or optionally, LNG may be produced while shuttle vessel 70 is connect via connection 33 and pumped directly into shuttle vessel 70 without the need to store LNG on floating liquefaction unit 330.

Shuttle vessels for transporting LNG are well known in the art, and any of the known vessels may be utilized in the preset invention as shuttle vessel 70.

LNG regasification units are well known in the art.

In the present invention, floating regasification unit 350 will generally include all of the necessary components of a regasification unit as are know to those of skill in the art. Floating regasification unit 350 may include storage tanks for receiving the LNG, or shuttle vessel 70 may serve as a storage tank by remaining docked with floating regasification unit 350 during the regasification process. Floating regasification unit 350 may also include storage tanks for the regasified natural gas, this gas may be provided to off-unit storage into mobile vessels during regasification. Connection 353 may be connected to a distribution system 85, which may be a pipeline system, storage tanks or mobile vessels.

Figure 8:
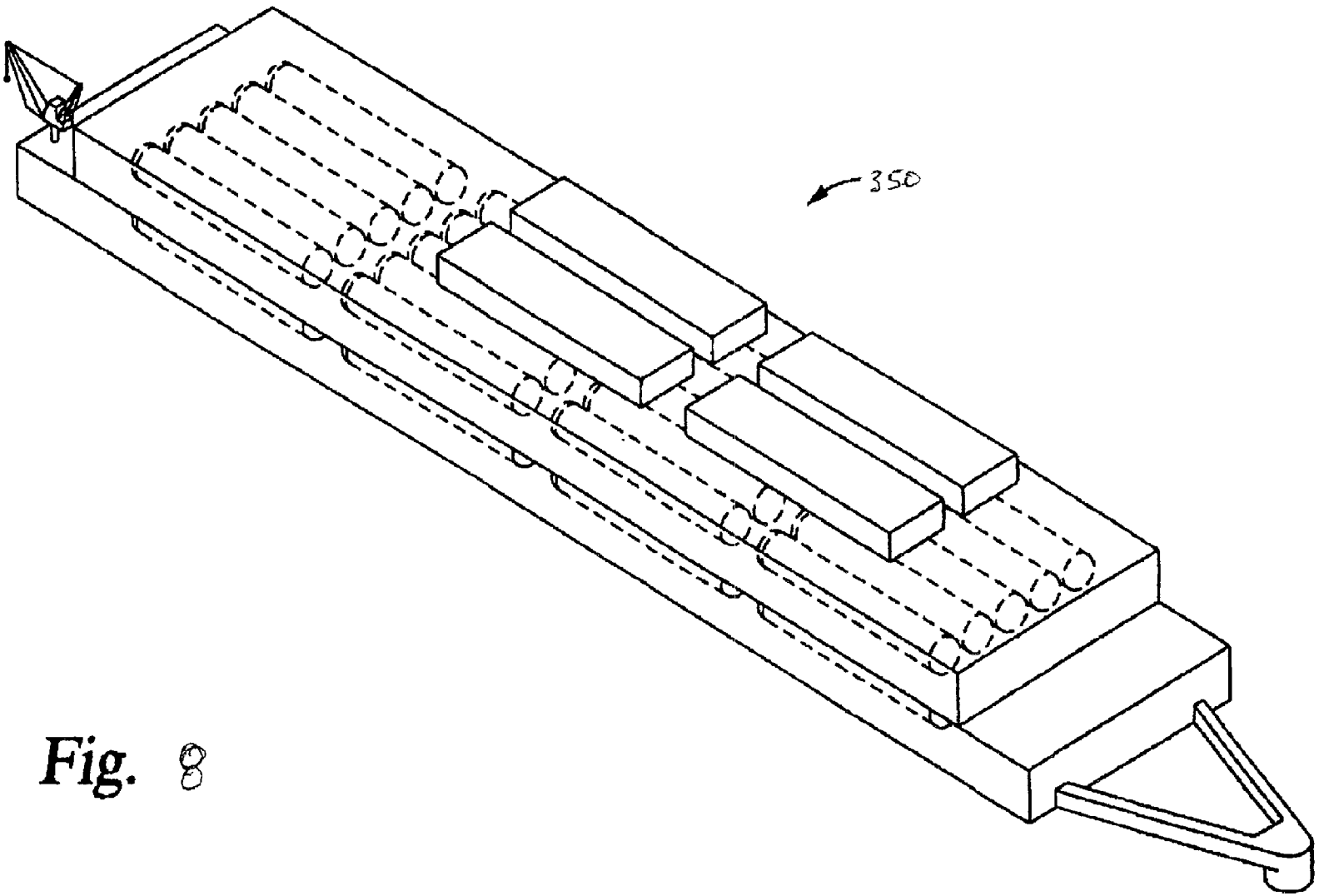
FIG. 8 is a drawing of a non-limiting embodiment of floating regasification unit.

Referring now to FIG. 8, there is shown a specific non-limiting embodiment of floating regasification unit 350 (also referred to sometimes as "FSRU", i.e., "Floating, Storage and Regasification Unit"). According to the present invention, such an FSRU 350 will be a commercially competitive option to GBS (gravity base structure) LNG import terminals.

It should be understood that the following details merely describe one possible non-limiting embodiment of FSRU 350, and that the present invention is not meant to be limited to any of the following specifics.

In the practice of the present invention, the hull of FSRU 350 may be constructed according to acceptable marine engineering principles, and may comprise any suitable material. In the embodiment as shown, the hull may comprise concrete.

Is should be understood that the hull of FSRU 350 may comprise any dimension as desired that may be constructed. In the embodiment as show, the hull is approximately 813 ft long, 181 ft wide, and 110 ft tall.

Storage capacity of FSRU 350 will be of course limited by and a function of the size of the hull. In the embodiment shown in FIG. 8, LNG storage of approximately 160,000 m3 capacity is obtained utilizing on the order of 32 horizontal tanks of 9% nickel steel, of 38 ft diameter and 176 ft long.

These tanks should each be in a concrete compartment surrounded by an insulation material such as perlite, and preferably utilize technology as disclosed and described in U.S. patent application Ser. No. 10/782,736, filed Feb. 19, 2004, the disclosure of which is incorporated by reference.

It should be understood that FSRU 350 will comprise marine systems and utilities as legally and/or technically necessary to operate as a stationary offshore floating vessel, and any others as may be optionally desired.

FSRU 350 may also include mooring and berthing equipment and systems as are known in the art. For example, FSRU 350 may comprise equipment for side by side and/or tandem mooring and berthing of LNG transport ships and lightering barges.

This non-limiting embodiment of FSRU 350 will have a send out rate of approximately 800 mmscfd to 1 billion scfd. The LNG vaporization process/equipment utilized may be any as are known in the art, including as a non-limiting example, open rack vaporizers, and/or as described in the below referenced "Baudat Applications."

This non-limiting embodiment FSRU 350 may comprise complete self contained utilities, including electric power, potable water, and fire protection.

FSRU 350 may also comprise crew quarters, helideck, vent/flare system, boat landing, lifeboats, and any other equipment as may be desired and/or required.

Field architecture for this embodiment of FSRU 350 may be as follows, location near an existing pipeline infrastructure, in water depths of 100 ft to 300 ft, accommodation for 1 or more additional FSRU facilities, mooring ability, an offtake pipeline, and/or LNG tanker and/or lightering barge approaches.

This non-limiting FSRU 350 may utilize any type of LNG transfer system. Non-limiting examples include a cryogenic hose based system utilizing side by side loading and tandem loading, or a system utilizing an intermediate mooring barge for tandem loading, and/or a submerged pipe and hose system for tandem loading.

Non-limiting FSRU 350 may utilize any type of mooring system/equipment. Preferably, FSRU 350 will utilize single point mooring to allow the FSRU to essentially weather vane around the risers (gas swivel for ANSI 600, nominal 1100 psig). Approximate water depth may be in the range of about 100 ft to about 300 ft, utilizing drag embedment or suction pile anchors, permanently connected and designed to survive inclement weather to which the situs is subject (i.e., hurricanes, typhoons and the like).

FSRU 350 may comprise LNG tanker facilities suitable for handing 138,000 m3 to 150,000 m3. Such facilities may accommodate side by side berthing for mid-ship offloading and/or tandem berthing for bow offloading and/or mid-ship offloading.

FSRU 350 may comprise barge handling facilities for handing approximately 20,000 m3 capacity, generally utilizing side by side berthing for loading.

Figure 9:
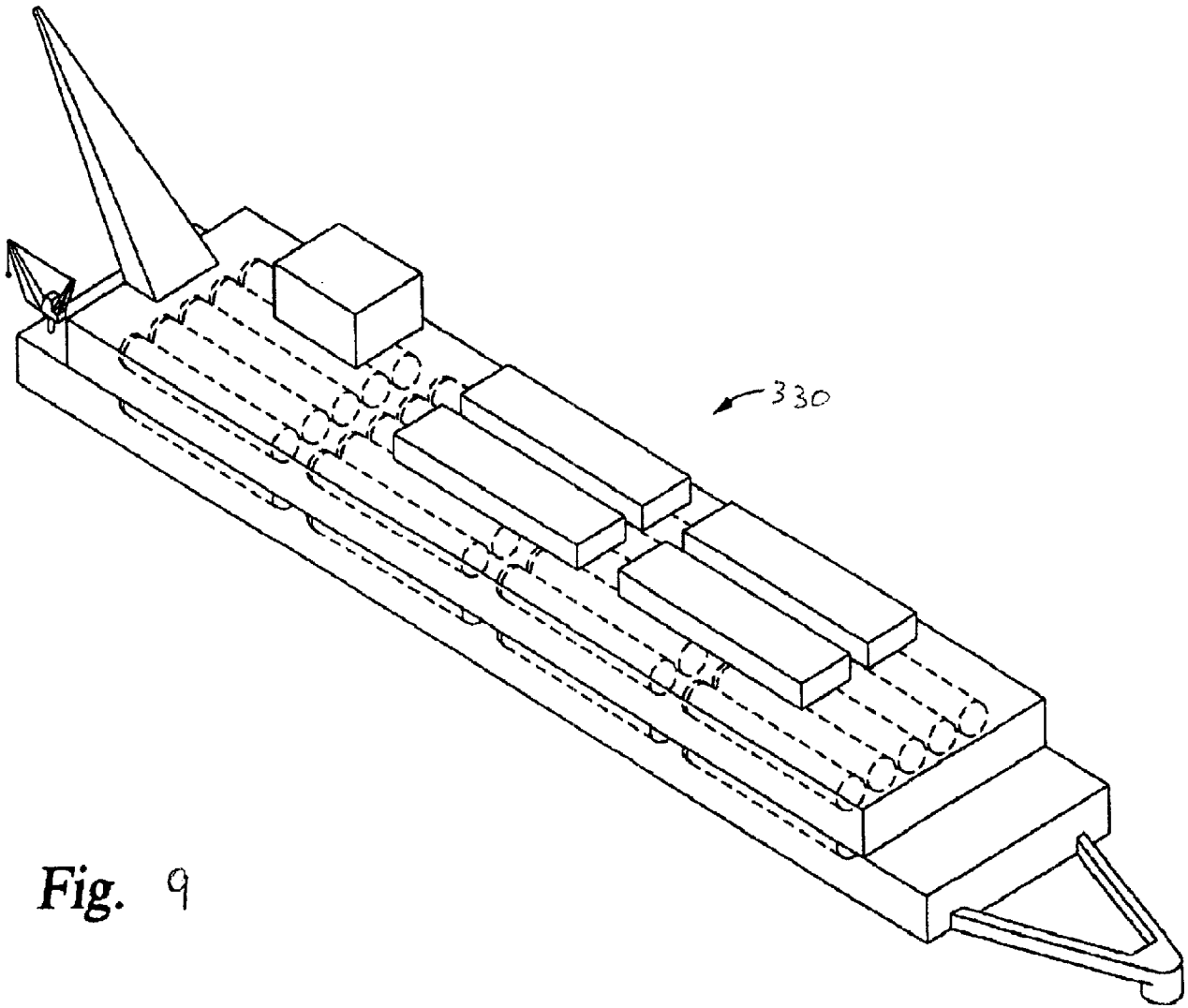
FIG. 9 is a drawing of non-limiting embodiment of floating liquefaction unit.

Referring now to FIG. 9, there is shown a specific non-limiting embodiment of floating liquefaction unit 330. (also referred to sometimes as "FPSO", i.e., "Floating, Production, Storage and Offloading vessel").

It should be understood that the following details merely describe one possible non-limiting embodiment of FPSO 330, and that the present invention is not meant to be limited to any of the following specifics.

In the practice of the present invention, the hull of FPSO 330 may be constructed according to acceptable marine engineering principles, and may comprise any suitable material. In the embodiment as shown, the hull may comprise concrete.

Is should be understood that the hull of FPSO 330 may comprise any dimension as desired that may be constructed. In the embodiment as show, the hull is approximately 813 ft long, 181 ft wide, and 110 ft tall.

Storage capacity of FPSO 330 will be of course limited by and a function of the size of the hull. In the embodiment shown in FIG. 8, LNG storage of approximately 160,000 m3 capacity is obtained utilizing on the order of 32 horizontal tanks of 9% nickel steel, of 38 ft diameter and 176 ft long.

These tanks may each be in a concrete compartment surrounded by a thermal insulating material such as perlite, and may utilize technology as disclosed and described in U.S. patent application Ser. No. 10/782,736, filed Feb. 19, 2004, the disclosure of which is incorporated by reference.

It should be understood that FPSO 330 will comprise marine systems and utilities as legally and/or technically necessary to operate as a stationary offshore floating vessel, and any others as may be optionally desired.

FPSO 330 may also include mooring and berthing equipment and systems as are known in the art. For example, FPSO 330 may comprise equipment for side by side and/or tandem mooring and berthing of LNG transport ships and lightering barges.

This non-limiting embodiment of FPSO 330 will have an LNG production rate ranging from about 50 to about 500 mmscfd. LNG liquefaction process/equipment utilized may be any as are known in the art, and/or as described in the below referenced "Baudat Applications."

This non-limiting embodiment FPSO 330 may comprise complete self contained utilities, including electric power, potable water, and fire protection.

FPSO 330 may also comprise crew quarters, helideck, vent/flare system, boat landing, lifeboats, and any other equipment as may be desired and/or required.

Field architecture for this embodiment of FPSO 330 may be as follows, location near a producing field or near an existing pipeline infrastructure, in water depths of 100 ft to 8000 ft, mooring ability, gas supply pipeline, and/or LNG tanker, equipment barge and/or lightering barge approaches.

This non-limiting FPSO 330 may utilize any type of LNG transfer system. Non-limiting examples include a cryogenic hose based system utilizing side by side loading and tandem loading, or a system utilizing an intermediate mooring barge for tandem loading, and/or a submerged pipe and hose system for tandem loading.

Non-limiting FPSO 330 may utilize any type of mooring system/equipment. FPSO 330 may utilize single point mooring to allow the FSRU to essentially weather vane around the risers (gas swivel for ANSI 600, nominal 1100 psig).

Approximate water depth will be in the range of about 100 ft to about 8000 ft, utilizing drag embedment or suction pile anchors, permanently connected and designed to survive the inclement weather to which the situs is subject (i.e., hurricanes, typhoons and the like).

FPSO 330 may comprise LNG tanker facilities suitable for handing 138,000 m3 to 150,000 m3. Such facilities may accommodate side by side berthing for mid-ship offloading and/or tandem berthing for bow offloading and/or mid-ship offloading.

FPSO 330 may comprise lightering barge handling facilities for handing approximately 20,000 m3 capacity, generally utilizing side by side berthing for loading.

In operation of transportation system 100, natural gas 5, whether directly from a well, storage tank or mobile vehicle, is provided via connection 331 to liquefaction unit 330. This natural gas is then liquefied in liquefaction unit 330, where it may or may not be stored first before being pumped via docking connection 33 into shuttle vessel 70. This shuttle vessel 70 then traverses body of water 340 to regasification unit 350. Docking connection 351 facilitates offloading of the LNG to regasification unit 350, either into storage tanks or directly into the regasification process. Once the LNG is regasified, it may be stored on regasification unit 350 or provided via connection 353 to off-unit storage tanks, a distribution pipeline, or to mobile vessels.

The present invention may incorporate any desirable apparatus and method features as described and/or taught in any of U.S. patent application Ser. No. 10/782,736 (filed Feb. 19, 2004), Ser. No. 10/777,506 (filed Feb. 11, 2004), Ser. No. 10/816,793 (filed Apr. 1, 2004), and Ser. No. 10/869,461 (filed Jun. 15, 2004), all by applicant Ned P. Baudat ("Baudat Applications"), the specifications of which are all herein incorporated by reference for all that they disclose and teach.

The floating system described above may comprise one or more of the storage system, vaporization system, and liquefaction system described below.

Cryogenic Storage System

The following cryogenic storage system may be utilized in floating liquefaction unit 330, floating regasification unit 350, and/or shuttle vessel 70.

Figure 1:
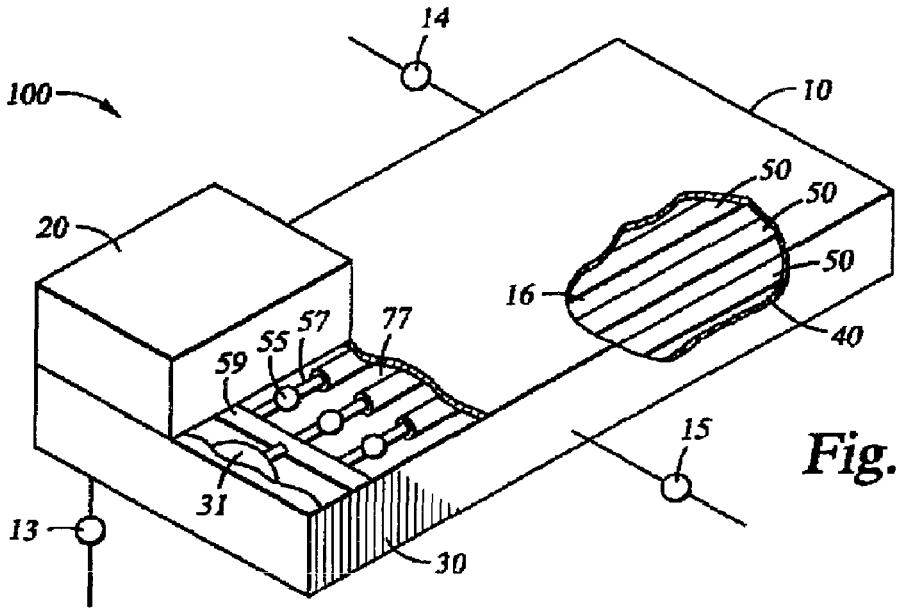
FIG. 1 shows one illustrative example of a storage system of the present invention, including a containment box which is divided into a pump section for housing the pump components, and into a storage section for housing a plurality of storage tanks, with a vaporizer optionally mounted to containment box.

Referring now to FIG. 1 there is shown a non-limiting example of storage system 100 of the present invention, including containment box 10 which is divided into a pump section 30 for housing one or more pumps 31, and into a storage section 40 for housing a multiplicity of storage tanks 50, with a vaporizer 20 optionally mounted to containment box 10.

One or more optional dividers 77 may be utilized to divide box 10 into various isolated compartments for safety and other reasons. As shown in FIG. 1, divider 77 isolates the pump section 30 from storage section 40.

Containment box 10 may be made of any material having physical properties suitable for the intended application of storage system 100. It is envisioned that storage system 100 may be utilized for in-ground storage, may be permanently affixed to a land or marine transportation vehicle, or may be transportable using a land or marine transportation vehicle. Thus, containment box 10 will be constructed accordingly as is known to those of skill in the art. Preferably, containment box 10 will comprise concrete, metal, and/or reinforced concrete.

Containment box 10 will be sized such that in the event of a leak from one or more tanks 50, containment box 10 is suitable to impound the entire contents of tanks 50. Preferably, pump section 30 will be sized suitable to hold the contents of one tank 50, more preferably the contents of one series of tanks 79. Because pump section 30 may be subjected to rain, a drain 13 may be conveniently provided.

Containment box 10 is further provided with charge line 14 and purge line 15, which can be utilized to purge an inert gas thru containment box 10 to provide an inert environment within containment box 10. Preferably, the inert gas utilized is nitrogen, although any other suitable inert gas may be utilized.

To provide the necessary thermal insulating effect, empty spaces in containment box 10 may be filled with insulation material 16, which is of a thickness and quality to maintain the gas in its liquid state with a controlled, relatively small amount of pressure rise. A suitable material for use would be perlite. Other alternatives include use of an insulated box 10, or even jacketing box 10 with insulation.

Of course, the amount/thickness of insulation utilized will vary according to the type of insulation material, and the desired pressure rise targeted. By way of non-limiting example, a mean insulation thickness of approximately 1 meter, would result in a controlled pressure rise of less than 1 psi/week (i.e., equivalent to a boil-off of less than 0.05%/day of the storage volume).

Positioned within storage section 40 are a plurality of storage tanks 50. The present invention is not intended to be limited to any particular number of, size of, nor geometric shape of, or arrangement of, tanks 50. Tanks 50 may be cylindrical type tanks. Alternatively, tanks 50 may be elongated horizontal cylindrical tanks, formed into one or more layers of two or more parallel tanks.

Optionally, storage section may be provided with one or more access ways to allow for maintenance, repair, inspection, and the like.

To minimize vapor recompression, the various tanks 50 may be suitable for a minimum of 15 psig to 50 psig operation pressure.

As one envisioned non-limiting example, storage system 100, intended to contain 100,000 $m^3$, comprises 11 elongated horizontal cylindrical tanks 50, each of 9100 $m^3$ (24' dia.× 710' T/T), arranged parallel to each other in one layer.

As another envisioned non-limiting example, storage system 100, intended to contain approximately 100,000 $m^3$, comprises 11 or 12 elongated horizontal cylindrical tanks 50, each of 9100 $m^3$. With 11 tanks, it is envisioned that the tanks are arranged as shown in FIG. 4, in a first (bottom) layer of 6 tanks parallel to each other, and in a second (top) layer of 5 tanks parallel to each other, with the tanks of the top layer offset from tanks of the bottom layer by the radius of the tanks.

With 12 tanks, it is envisioned that the tanks are arranged as shown in FIG. 3, in a first (bottom) layer of 6 tanks parallel to each other, and in a second (top) layer of 6 tanks aligned directly on top of each other.

As even another envisioned non-limiting example, storage system 100, intended to contain 190,000 $m^3$, comprises 21 elongated horizontal cylindrical tanks 50, each of 9100 $m^3$, arranged in a first (bottom) layer of 11 tanks parallel to each other, and in a second (top) layer of 10 tanks parallel to each other, with the tanks of the top layer offset from tanks of the bottom layer by the radius of the tanks.

Further envisioned non-limiting examples may comprise the aforementioned non-limiting examples of system 100 with each of the 9100 $m^3$ vessels made up of multiple vessels manifolded together in series.

In the practice of the present invention, containment system 100 may be provided with one or more pumps 31 for filling tanks 50.

In a filling operation, LNG is pumped into storage system 100 through charge line 38 to header 59 where a number of lines 57 fill the various tanks 50. While manifold 59 and lines 57 could optionally be positioned within the insulated tank section 40, it would be more difficult to maintain and operate. Manifold 59 and line 57 may be positioned in the pump section 30 as shown. LNG charge line 38, manifold 59 and line 57 may be vacuum jacketed.

In an emptying operation, pump 31 pumps LNG through charge line 53 in communication with header 59, and discharges the LNG through discharge line 37 to vaporizer 20.

Containment system 100 may be provided with a manifold system 51 comprising piping, manifold header 59, fill lines 57, and manifold valves 55 to selectively fill/empty the various tanks 50. As non-limiting examples of selectively filling/emptying, the various tanks 50 may be filled/emptied in series (i.e., one after another in any order), or parallel (i.e., all at once). Such a manifold system 51 may be utilized to isolate the various tanks 50 from each other, or may be utilized to equalize the pressure between the various tanks 50.

Figure 2:
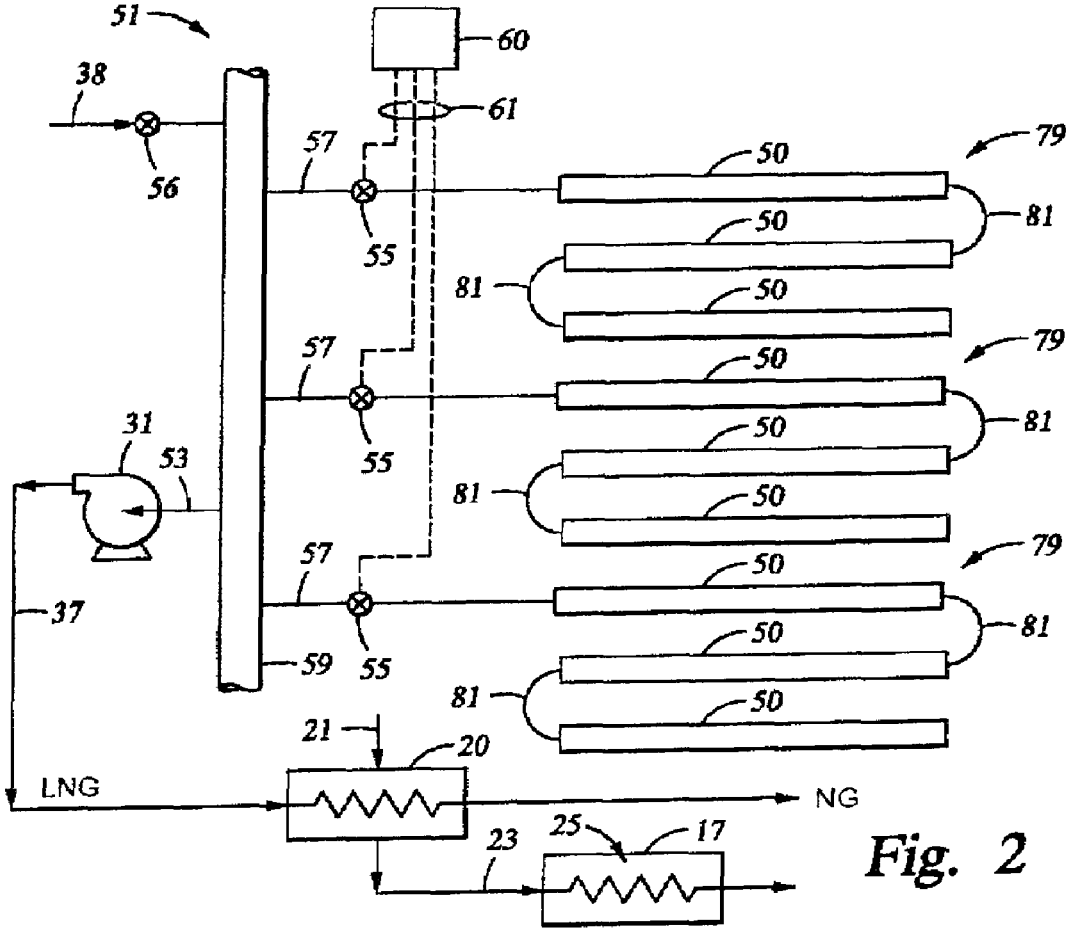
FIG. 2 is a schematic wherein storage system is divided into a pump section for housing the pump components, and into a storage section for housing a multiplicity of storage tanks, with a vaporizer optionally mounted to containment box.

As shown in FIG. 2, to reduce the number of necessary valves 55, the various tanks 50 may be arranged in groups 79 comprising three tanks connected in series by piping 81, with each group 79 connected to the manifold in parallel to the other groups 79. Of course, groups 79 may comprise any desired number of tanks, with each group 79 having the same or different number of tanks 50.

Other arrangements of tanks 50 are envisioned. As another non-limiting example, each tank 50 could be connected directly to manifold 59 as shown in FIG. 5. As even another non-limiting example, FIG. 6 shows tanks 50 in which each group of tanks 79 comprises a linear arrangement of tanks, with each group of tanks 79 connected in parallel to manifold 59. This arrangement is believed to minimize the movement of the individual tanks in the series connections.

Controller 60 for controlling the various manifold valves 55 may be manually operated, or computer controlled. Instructions from controller 60 are relayed to the various manifold valves 55 by way of communications line 61, although it is understood that the instructions may be provided utilizing a wireless connection.

In the practice of the present invention, the various pumps 31 are not intended to be limited to any particular type of pump, but rather may be any suitable pump as known to those of skill in the art. Of course, being positioned adjacent to tanks 50 which may contain explosive materials, the pumps and attendant controls and wiring, may be required to be explosion-proof.

Pump 31 discharges through discharge line 37 into vaporizer 20 where the cryogenic fluid is vaporized into a gas. In the practice of the present invention, vaporizer 20 is not intended to be limited to any particular type of heat exchange device, but rather may be any suitable heat exchange device as known to those of skill in the art. For example, vaporizer 20 may be an open rack vaporizer or ambient air vaporizer.

The present invention is not intended to be limited by the positioning of vaporizer 20. In one non-limiting embodiment, vaporizer 20 may be positioned immediately adjacent to box 10, and may be mounted to the side or top of box 10.

In operation, pump 31 is energized to pump liquid LNG to be vaporized through manifold header line 53 to vaporizer 20. Heat necessary to vaporize the LNG is provided by inlet line 21 carrying the heat exchange medium (most commonly air or water). Vaporizer 20 may optionally be operated in such a manner that the cooled heat exchange medium stream 23 still has sufficient heat to be used to warm ground or foundation 17 beneath containment system 100 (if positioned on the ground). Generally, this means that the cooled heat exchange medium is sufficiently above the freezing point of water to keep the ground thawed. Thus, cooled heat exchange medium then proceeds via outlet piping 23 to be circulated beneath system 100 forming heater 25 positioned in ground or foundation 17. Any suitable arrangement of piping may be utilized for heater 25. For example, heater 25 piping may form a spiral pattern, or run beneath system 100 in a back-and-forth manner, or any other suitable pattern or arrangement.

While the simplest manner of forming heater 25 will be to form piping into a suitable patter or arrangement, it is also contemplated that specialized baffles, manifolds or other heat exchange equipment as is known to those of skill in the heat exchange art may be utilized.

It should be understood that heater 25 may be used to completely replace the traditional electrical heaters used beneath LNG tanks, or may be used to supplement such traditional heaters.

Cryogenic storage system 100 may optionally be provided with any number of internal dividing walls 77 within box 10 to compartmentalize box 10 as desired to facilitate operation, maintenance and/or safety. Optionally, entry to box 10 may be gained by providing entryways as desired. For example, in addition to isolation pump section 30 with divider 77, a tank 50, or groups of tanks 50, may be so isolated. Preferably, each series of tanks 79, would be isolated with dividers 77.

It is anticipated, that cryogenic system 100 of the present invention may be incorporated into an LNG transportation system, most notably to store LNG at locations remote to the LNG plant while it awaits subsequent use or further transportation. For example, one or more cryogenic systems 100 may be incorporated into an LNG terminal that receives LNG from marine vessels, rail, truck, air, or other transport.

The cryogenic storage system 100 of the present invention may also find utility when incorporated into an LNG plant, specifically for storing the output of an LNG plant.

LNG Liquefaction Process

The following LNG liquefaction process may be utilized in floating liquefaction unit 330.

Figure 10:
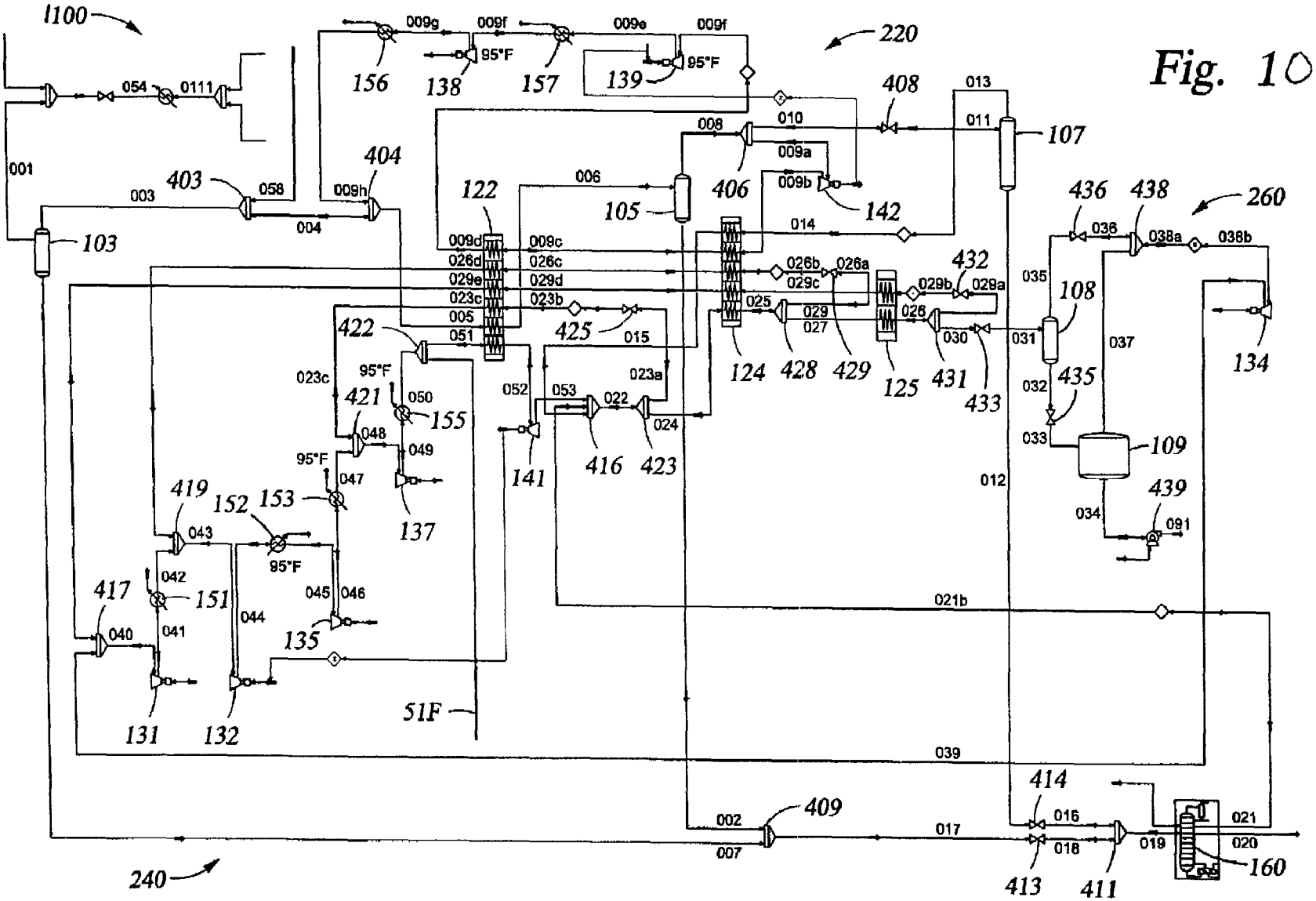
FIG. 10 is a schematic process flow diagram illustrating one embodiment of a process and apparatus of the present invention.

FIG. 10 shows one non-limiting example of a schematic illustrating one embodiment of a process and apparatus of the present invention for use in liquefying hydrocarbons to produce LNG. FIG. 10 shows various process streams and equipment for accomplishing the liquefaction. Process 1100 includes as main process loops, the gas cooling loop 220, LNG cooling loop 240, and liquefaction loop 260. The main process equipment includes separators 103, 105, 107 and 108, compressors 131, 132, 135, 137, 138,139, and 134, liquefaction exchangers 122, 124, 125, distillation unit 160, and LNG storage tank 109.

It should be understood that the proposed design operating conditions (i.e., temperature, pressure, flowrates) for the various process streams shown in FIG. 10, can vary depending upon the composition of the input feed gas being processed, equipment design variations, process design variations, and the particular manner in which the equipment and process are being operated. In addition, conditions may also vary depending upon particular operating goals/limitations, which force/require that any plant be operated in a certain manner. Flowrates, of course, vary depending upon plant capacity and size. It should also be noted, that any temperatures, pressures, flowrates, heating/cooling duties, and the like, shown in FIG. 10 should be considered merely design examples, and that may vary depending upon any number of design/operational circumstances. It is to be understood that values inside or outside those ranges could be utilized, given particular circumstances.

By way of non-limiting examples only, shown in Table 1 are temperature and pressure ranges are provided for a number of the process streams in FIG. 10.

Also by way of non-limiting example only, shown in Table 2 are composition ranges for a number of selected streams.

TABLE 1 examples of temperature and pressure ranges for selected process streams.

| Stream | Temperature Range (F.) | Pressure Range (psia) |
|---|---|---|
| 6 | 20 to −20 | 2000 to 850 |
| 001 | 20 to −20 | 2000 to 850 |
| 002 | 20 to −20 | 2000 to 850 |
| 003 | 20 to −20 | 2000 to 850 |
| 005 | 20 to −20 | 2000 to 850 |
| 006 | −30 to −60 | 2000 to 850 |
| 007 | −30 to −60 | 2000 to 850 |
| 008 | −30 to −60 | 2000 to 850 |
| 009b | −125 to −175 | 175 to 225 |
| 050 | 85 to 125 | 675 to 750 |
| 052 | 10 to 50 | 675 to 750 |
| 053 | −75 to −35 | 200 to 300 |
| 028 | −250 to −220 | 200 to 300 |
| 034 | −265 to −250 | 15 to 30 |
| 019 | −125 to −75 | 250 to 350 |
| 020 | 275 to 375 | 250 to 350 |
| 021 | 30 to 60 | 250 to 350 |

TABLE 2 examples of composition ranges for selected process streams (mole percent).

| Stream No. | C1 | C2 | C3 | C4 | C5+ |
|---|---|---|---|---|---|
| 6 | 80-90 | 0-10 | 0-10 | 0-5 | 0-5 |
| 001 | 80-90 | 0-10 | 0-10 | 0-5 | 0-5 |
| 002 | 30-60 | 10-30 | 10-30 | 10-30 | 10-30 |
| 003 | 85-95 | 0-10 | 0-10 | 0-5 | 0-5 |
| 005 | 85-95 | 0-10 | 0-10 | 0-5 | 0-5 |
| 006 | 85-95 | 0-10 | 0-10 | 0-5 | 0-5 |
| 007 | 50-70 | 5-20 | 5-20 | 0-5 | 0-5 |
| 008 | 85-95 | 0-10 | 0-10 | 0-5 | 0-5 |
| 009b | 85-95 | 0-10 | 0-10 | 0-5 | 0-5 |
| 050 | 85-95 | 0-10 | 0-10 | 0-5 | 0-5 |
| 052 | 85-95 | 0-10 | 0-10 | 0-5 | 0-5 |
| 053 | 85-95 | 0-10 | 0-10 | 0-5 | 0-5 |
| 028 | 85-95 | 0-10 | 0-10 | 0-5 | 0-5 |
| 034 | 85-95 | 0-10 | 0-5 | 0-1 | 0-1 |
| 019 | 30-70 | 10-30 | 10-30 | 5-10 | 5-10 |
| 020 | 0-1 | 0-1 | 0-5 | 1-10 | 75-95 |
| 021 | 30-70 | 10-30 | 10-30 | 1-5 | 0-1 |

It should be understood that the various physical components of the present invention may be any that are well known to those of skill in the art. The patentability of the apparatus of the present invention does not reside in the patentability of any single piece of equipment, but rather in the unique and nonobvious arrangement of the various equipment to form the overall apparatus or portion of the apparatus. Likewise, individual process steps are generally known to those of skill in the art. The patentability of the process of the present invention does not reside in the patentability of any single process step, but rather in the unique and nonobvious arrangement of the various process steps to form the overall process or a portion of the process.

Inlet gas stream 001 comprises natural gas. As used throughout the specification, natural gas is understood to mean raw natural gas or treated natural gas. Raw natural gas primarily comprises light hydrocarbons such as methane, ethane, propane, butanes, pentanes, hexanes and impurities like benzene, but may also comprise small amounts of non-hydrocarbon impurities, such as nitrogen, hydrogen sulfide, carbon dioxide, and traces of helium, carbonyl sulfide, various mercaptans or water. Treated natural gas primarily comprises methane and ethane, but may also comprise a small percentage of heavier hydrocarbons, such as propane, butanes and pentanes.

While natural gas ideally contains primarily light hydrocarbons, it may also comprise small amounts of non-hydrocarbon impurities, such as nitrogen, hydrogen sulfide, carbon dioxide, and traces of helium, carbonyl sulfide, various mercaptans or water. The exact percentage composition of the raw natural gas is dependant upon its reservoir source and any gas plant pre-processing steps. For instance, natural gas may comprise as little as 55 mole percent methane. However, it is preferable that the natural gas suitable for this process comprises at least about 75 mole percent methane, more preferably at least about 85 mole percent methane, and most preferably at least about 90 mole percent methane for best results. Likewise, the exact composition of the non-hydrocarbon impurities also varies depending upon the reservoir source of the natural gas.

Consequently, it is often necessary to pretreat the natural gas to remove high concentrations of non-hydrocarbon impurities, such as acid gases, mercury and water, that can damage, freeze and plug lines and heat exchangers or other equipment used in the process.

A common optional pretreatment for inlet gas stream 001 includes passing it thru an amine absorber to remove $CO_2$. In addition to its corrosivity, $CO_2$ will also solidify at cryogenic temperatures and cause operational problems in the cryogenic liquification exchanger. Generally, gas to be pretreated thru an amine absorber is first heated to about 100 F, as the heating prevents/reduces foaming in the amine absorption process and increases mass transfer of the $CO_2$ to the amine fluid.

Another common pretreatment for inlet gas stream 001 includes passing it thru a mercury guard bed, as mercury is corrosive to the aluminum equipment commonly used in cryogenic operations. Even if mercury is not seen in the process, it is generally preferred to guard against its presence.

Of course, impurities will vary from gas source to gas source, and any other pretreatments as dictated by the impurities of the particular gas source may be utilized.

Inlet gas stream 001 is received by inlet separator 103 where it is separated into gas stream 003 and liquid stream 002 (the computer model shown in FIG. 10, assumes that stream 006 is split into equal streams 001 and 002, with stream 002 flowing to a second identical process 200.

Gas cooling loop 220 is fed by gas stream 003 which is shown flowing to optional tee 403 where it may be split into rarely used optional emergency fuel gas stream 058 and gas stream 004. Process gas stream 004 flows to tee 404 where it is combined with recycle gas stream **009*h* to form gas stream 005. As will be shown below, this recycle gas stream 009*h* completes cooling loop 220**.

Gas stream 005 is now passed thru a lower, generally first stage of LNG liquefaction exchanger 122 ($1^{st}$ flow path thru the liquefaction exchanger) where it is cooled to about −50 F and partially condenses.

LNG liquefaction exchanger used herein may be any suitable exchanger known to those of skill in the art, but are preferably multi-sided brazed-aluminum plate-fin heat exchanger. Many streams can enter and exit the exchanger and provide heating or cooling duty to one or more streams simultaneously. One stream may even enter and exit the exchanger several times to achieve staged cooling. The exchanger may be a single exchanger, or may be a combination of several exchanger units, depending on manufacturing availability and/or process design needs. In the non-limiting example shown herein, the liquefaction exchanger comprises exchangers 122, 124 and 125, which may also be thought of as stand alone exchangers, or may be thought of as first, second and third zones of the liquefaction heat exchanger.

Cooled gas stream 005, exiting as gas stream 006, is received by separator 105 where it is separated into gas stream 008 and liquid stream 007. Tee 406 separates gas stream 008 into gas streams 009*a* and 010.

Gas stream 010 is used to regulate the volume and flow of gas cooling loop 220, and is expanded and cooled into partially condensed stream 011 having a pressure of about 280 psia by expander 408, non-limiting examples of which include a turboexpander or a joule-Thompson valve. Received into separator 107, stream 011 is separated into gas stream 013 and liquid stream 012. This gas stream 013 becomes gas stream 014 and passes thru LNG liquefaction exchanger ($9^{th}$ flow path) exiting as stream 015 and feeding into mixer 416.

Gas stream 009*a* is expanded by expander 142 to a pressure of about 225 psia into expanded cool gas stream 009*b* to provide cooling duty to the liquefaction exchangers. Gas stream 009*b* is passed thru an upper stage of LNG liquefaction exchanger 124, exiting as gas stream 009*c*, which is then passed thru an upper stage of LNG liquefaction exchanger 122, exiting as gas stream 009*d* ($2^{nd}$ flow path thru exchangers 124 and 122).

Before gas stream 009*d* can be recycled back to join inlet gas 004 and complete gas cooling loop 220, its pressure must be increased and its temperature cooled to match that of inlet gas stream 004. While one compressor and one heat exchanger could be utilized, the embodiment as shown in FIG. 10, utilizes compressors 138 and 139, and heat exchangers 156 and 157.

Gas stream 009*d* is compressed by methane booster compressor 139 into discharged gas stream 009*e* having a pressure of about 310 psia. This methane booster compressor 139 is driven by methane expander 142, so the discharge pressure of methane booster compressor depends on the mechanical efficiency of both devices. Stream 009*e* exits heat exchanger 157 as a cooler stream 009*f* at a temperature of about 95 F.

This gas stream 009*f* is compressed by methane compressor 138 into discharged gas stream 009*g* having a pressure of about 310 psia. Stream 009*g* exits heat exchanger 157 as a cooler stream 009*h* at a temperature of about 95 F, and then joins gas stream 004 to complete gas cooling loop 220.

Generally, one or more, preferably all, of the liquid streams removed from gas cooling loop 220 are sent to distillation tower 160. In the embodiment as shown in FIG. 10, liquid streams 002 and 007 are combined at tee 409 into liquid stream 017 which passes thru valve 413 exiting as stream 018. Liquid stream 012 passes thru valve 414 and exits as stream 016. These streams 016 and 018 are combined at tee 411 into stream 019 which is received by distillation tower 160. Heavy hydrocarbon components exit the bottom of distillation tower as stream 020, and may be blended with crude product from the production site, or otherwise sold or disposed. Overhead stream 021 becomes stream 021*b* and flows into LNG cooling loop at mixer 416.

The front end of LNG cooling loop 240 is fed by stream 039 which comprises recovered vapors from LNG receiver 108 and LNG storage tank 109, and recycled cooling stream 029*e*, which are combined at tee 417 into feed stream 040. While the present embodiment is shown illustrated with a series of four compressors 131, 132, 135 and 137 utilized in LNG cooling loop 240, it should be understood that any number of compressors may be utilized as dictated by the process design and economics.

Stream 040 is compressed in first stage LNG compressor 131 and discharged as stream 41 at a pressure of about 85 psia. This stream 041 is cooled by air-cooler 151 into cooled stream 042 having a temperature of about 95 F. Recycled cooling stream 026*d* and stream 041 are combined at mixer 419 into stream 043.

Stream 043 is compressed in LNG booster compressor 132 and discharged as stream 044 at a pressure of about 110 psia. This stream 044 is cooled by air-cooler 152 into cooled stream 045 having a temperature of about 95 F. The LNG booster expander 132 is driven by the LNG refrigerant expander 141, so the discharge pressure of the LNG booster compressor depends on the mechanical efficiency of both devices.

Stream 045 is compressed in third stage LNG compressor 135 and discharged as stream 046 at a pressure of about 205 psia. This stream 046 is cooled by air-cooler 153 into cooled stream 047 having a temperature of about 95 F. Recycled cooling stream 023*c* and stream 047 are combined at mixer 421 into stream 048.

Stream 048 is compressed in fourth stage LNG compressor 137 and discharged as stream 049 at a pressure of about 740 psia. This stream 049 is cooled by air-cooler 155 into cooled stream 050 having a temperature of about 95 F.

Optional tee 422 splits stream 050 into optional stream 051F to allow for fuel gas takeoff if desired, and into stream 051 which is passed thru LNG liquefaction exchanger 122 exiting as stream 052 cooled to about 25 F ($3^{rd}$ flow path). Gas stream 052 then enters LNG refrigerant expander 141 where it exits as stream 053 at a pressure of about 265 psia and a temperature of about −60 F.

At mixer 416, this stream 053 is combined into stream 022 with earlier described stream 021*b* from overhead of distillation tower 160, and with earlier described stream 015 from overhead of separator 107. It should be understood that these streams 021*b* and 015 may be introduced into LNG cooling loop 240 at any number of suitable points. Preferably, streams 021*b* and 015 are introduced into LNG cooling loop 240 to rather immediately through the $4^{th}$ flow path, although any number of other points might also be suitable depending upon process conditions. Generally, streams 021*b* and 015 are introduced into LNG cooling loop 240 at points that are efficient for the process, which generally means trying to match temperature, pressure, and/or composition of these streams to the introduction point.

Stream 022 is split by tee 423 ($1^{st}$ splitter) into streams 023*a* and 024B. Stream 023*a* is expanded thru valve 425 into stream 023*b*, which passes thru LNG liquefaction exchanger 122 ($6^{th}$ flow path), exiting as earlier described recycled cooling stream 023*c* which feeds into mixer 421.

Stream 024 passes thru LNG liquefaction exchanger 124 ($4^{th}$ flow path), exiting as stream 025, which is split by tee 428 into stream 026*a* and stream 027.

Stream 026*a* is expanded thru valve 429 into stream 026*b*, which passes thru LNG liquefaction exchanger 124, exiting as stream 026*c*. This stream 026*c* then passes thru LNG liquefaction exchanger 122, exiting as earlier described recycled cooling stream 026*d* which feeds into mixer 419 ($7^{th}$ flow path thru exchangers 124 and 122).

Stream 027 passes thru LNG liquefaction unit 125 exiting as stream 028 ($5^{th}$ flow path). This stream 028 is split tee 431 into streams 029*a* and 030.

Stream 029*a* is expanded thru valve 432 into stream 029*b*, which passes thru LNG liquefaction exchanger 125, exiting as stream 029*c*. Next, stream 029*c* passes thru LNG liquefaction exchanger 124, exiting as stream 029*d*. This stream 029*c* then passes thru LNG liquefaction exchanger 125 ($8^{th}$ flow path through exchangers 125, 124 and 122), exiting as earlier described recycled cooling stream 029*e* which feeds into mixer 417 at the front end of LNG cooling loop 240.

It should be understood that the various recycle streams 029*e*, 026*d*, 023*c* can be recycled back into LNG cooling loop 240 at more points than just those shown in FIG. 10. Generally, these recycle streams in recycled back into LNG cooling loop 240 at points that are efficient for the process, which generally means trying to match temperature, pressure, and/or composition of the recycle stream to the recycle point.

Gas stream 030 is expanded thru valve 433 where it liquefies, forming stream 031 at pressure of about 20 psia and a temperature of about −250 F. This LNG stream 031 is received by LNG receiver vessel 108.

LNG receiver vessel liquid stream 032 passes thru valve 435 and enters as stream 033 into LNG storage tank 109. LNG receiver vessel vapor stream 035 passes thru valve 436 forming stream 036, which is joined at mixer 438 by LNG storage tank vapor stream 037, to form stream 038*a* which becomes stream 038*b*. LNG boiloff compressor 134 compresses stream 038*b* to about 25 psia into earlier described stream 039, which feeds into mixer 417 at the front end of LNG cooling loop 240.

Liquid remaining in LNG storage tank 109 is the final LNG product and can be sold or stored as necessary. LNG product stream 034 feeds into the intake side of LNG product pump 439.

LNG Vaporization Process

The following LNG vaporization process may be utilized in regasification unit 350.

Figure 11:
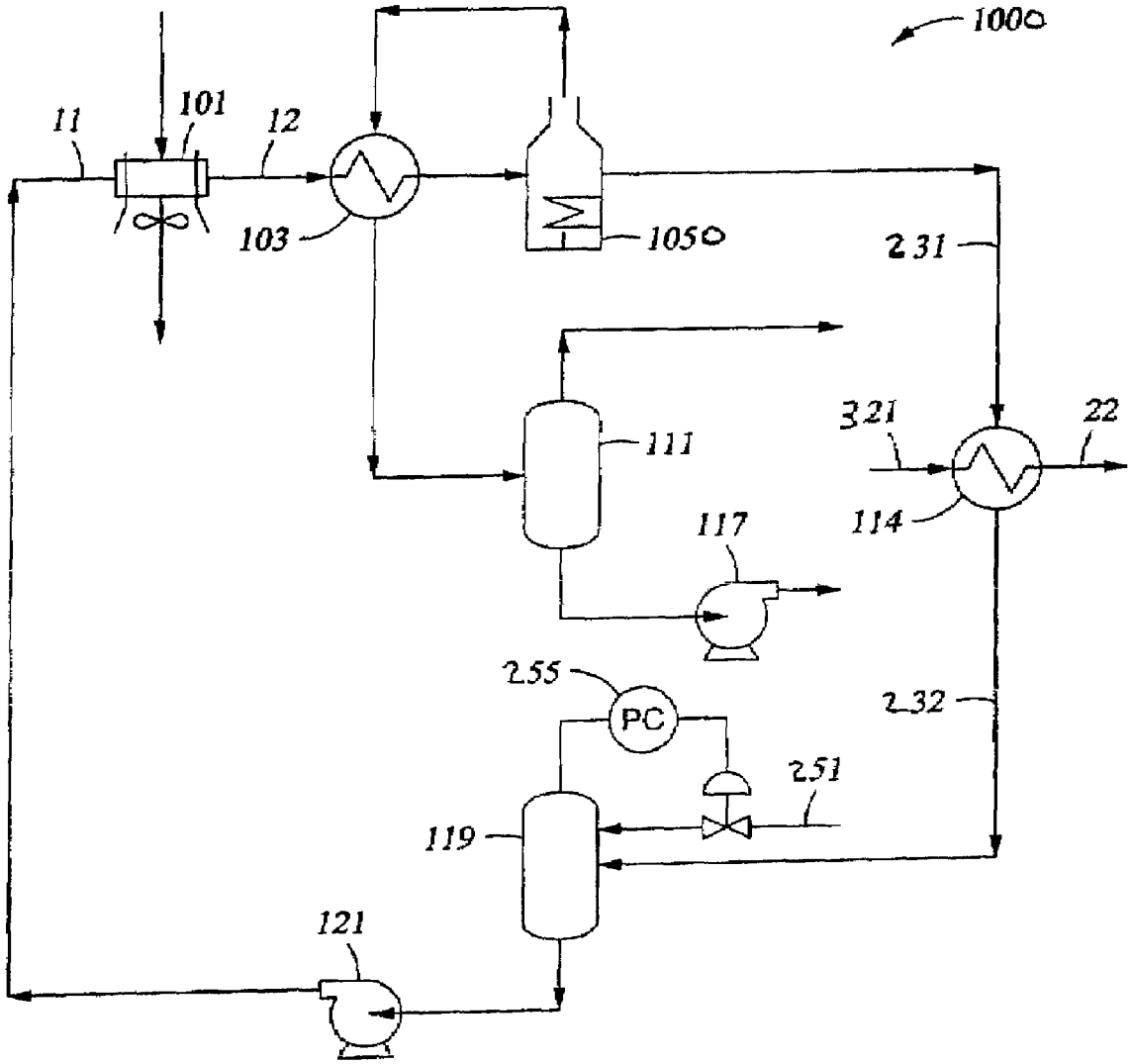
FIG. 11 is a process flow schematic showing a regasification system.

In one non-limiting embodiment of an apparatus and method of vaporizing, also called gasifying, a cryogenic fluid such as LNG, FIG. 11 shows a process flow schematic showing regasification system 1000 having air exchange pre-heater 101, economizer 103, heater 1050, water knockout 111, vaporizer 114, produced water pump 117, circulating fluid surge tank 119, and circulating fluid pump 121.

LNG is provided to vaporizer 114 via piping 321 at around −252 F, and exits vaporizer 114 via piping 22 as gaseous natural gas at about 40 F. A circulating heat transfer fluid is provided to vaporizer 114 via piping 231, and exits vaporizer 114 via piping 32 as a cooled heat transfer fluid.

Heat transfer fluids suitable for use in the present invention include hydrocarbons, non-limiting examples of which include propane and butane, ammonia, glycol-water mixtures, formate-water mixtures, methanol, propanol, and other suitable heat transfer fluids as may be useful under the operating conditions.

The heat transfer fluid is circulated in a closed system through air exchange pre-heater 101 where it is first heated after being cooled in vaporizer 114, then through economizer 103/heater 105 where it may be further heated if necessary, then through vaporizer 114 where it is utilized to provide heat of vaporization to the LNG, before returning to pre-heater 101. This heat transfer circulation system may be provided with one or more surge tanks 119 as necessary. Circulation of the heat transfer fluid is maintained by one or more circulation pumps 121. A nitrogen line 251 and pressure controller 255 maintain pressure of the heat transfer circulation system as desired.

In the practice of the present invention, heat is provided from ambient air to the heat transfer fluid across a heat transfer surface rather than by direct contact between the ambient air and heat transfer fluid. For example, the heat transfer fluid is passed through the tubes of a heat exchanger while the ambient air passes through the shell side.

Under certain conditions (see Examples 1, 2 and 3 below), ambient air will provide all of the heating necessary without the need for the economizer 103/heater 1050 providing any heating duty.

When heater 1050 is necessary it will be most efficiently run in conjunction with economizer 103, in which the exit effluent from heater 1050 routed to economizer 103 to heat the LNG or other cryogenic fluid. The cooled effluent exits economizer 103 and flows to water knockout tank 111. Pump 117 eliminates produced water from the system.

A second non-limiting embodiment of the apparatus and methods of the present invention is best described by reference to FIG. 12, which is a process flow schematic showing regasification system 2000 having tube-in-tube air exchanger 201, economizer 203, vaporizer 214, produced water knockout 211, produced water pump 217, warming medium accumulator 219 and warming medium pump 221.

In this embodiment, heat exchanger 201 is a tube-in-tube air exchanger (i.e, two tubes arranged in a concentric fashion), in which the cryogenic fluid passes through the inner most tube, pump 221 circulates the heat transfer fluid through the annular space between the two tubes, and ambient air passes over the surface of the outer tube. Accumulator 219 provides volume to the system to aid in heat transfer. For those times when the ambient air is too cool, extra heating may be provided by heater 214/economizer 203. Hot exit effluent from heater 214 routed to economizer 203 to heat the LNG or other cryogenic fluid. The cooled effluent exits economizer 203 and flows to water knockout tank 211. Pump 217 eliminates produced water from the system.

The methods and apparatus of the present invention also provide for retrofitting of pre-existing cryogenic regassification apparatus.

In its simplest aspect, regassification which involves closed loop circulation of a heat transfer fluid thru a heater and then into a vaporizer to heat and vaporize a cryogenic fluid, may be modified by placing an ambient air heat exchanger ahead of the heater to either pre-heat or fully heat the heat transfer fluid. Of course, there will not be direct contact of the heat transfer fluid with the ambient air, but rather indirect contact across a heat transfer service.

Figure 13:
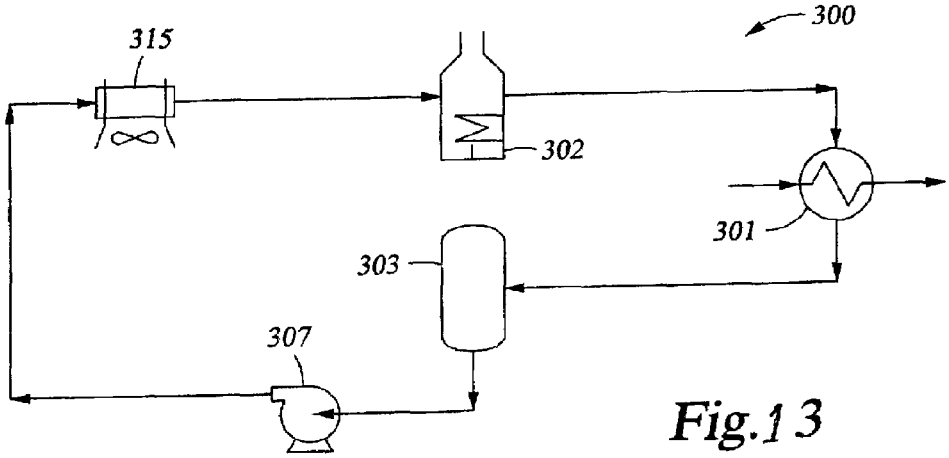
FIGS. 13 and 14 are schematics showing a retrofit of a typical ethylene glycol LNG vaporization system.

For example, referring now to FIG. 13, there is shown a retrofit of a typical ethylene glycol LNG vaporization system 300 having heater 302, LNG vaporizer 301, accumulator 303, and circulation pump 307. In a method of retrofitting/modifying the system to form a retrofitted/modified system, air pre-heater 315 is added just upstream of heater 302 to serve as a pre-heater and/or heater.

Figure 16:
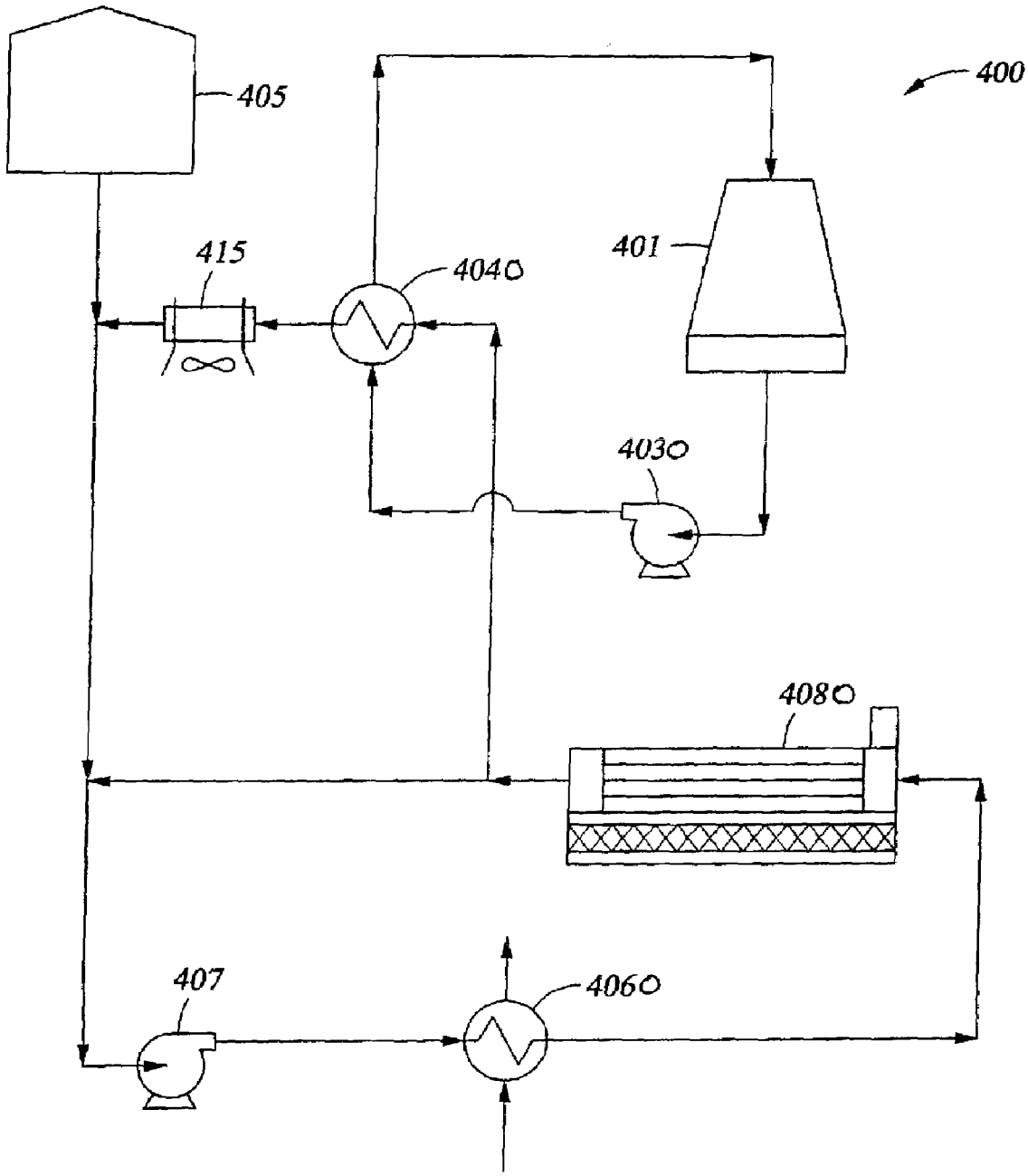
FIGS. 16 and 17 are schematics showing a retrofit of a typical cooling tower vaporization system.

Referring now to FIG. 16, there is shown a retrofit of a typical cooling tower vaporization system 400, having cooling tower 401, pump 4030, exchanger 4040, tank 405, LNG vaporizer 4060, pump 407 and submerged bath heater 4080. In a method of retrofitting/modifying the system to form a retrofitted/modified system, air pre-heater 415 is added. However, instead of preheating the LNG, this heater 415 serves to heat the heat transfer fluid flowing through vaporizer 4060.

More complex modification/retrofitting of such existing systems involve taking a side stream of the cryogenic fluid and routing it thru a vaporizer in which the vaporizer heat transfer fluid has been heated by ambient air in the manner of the present invention. Essentially, such a retrofit is the addition of the apparatus and method of the present invention to handle at least a portion of the vaporization.

Figure 14:
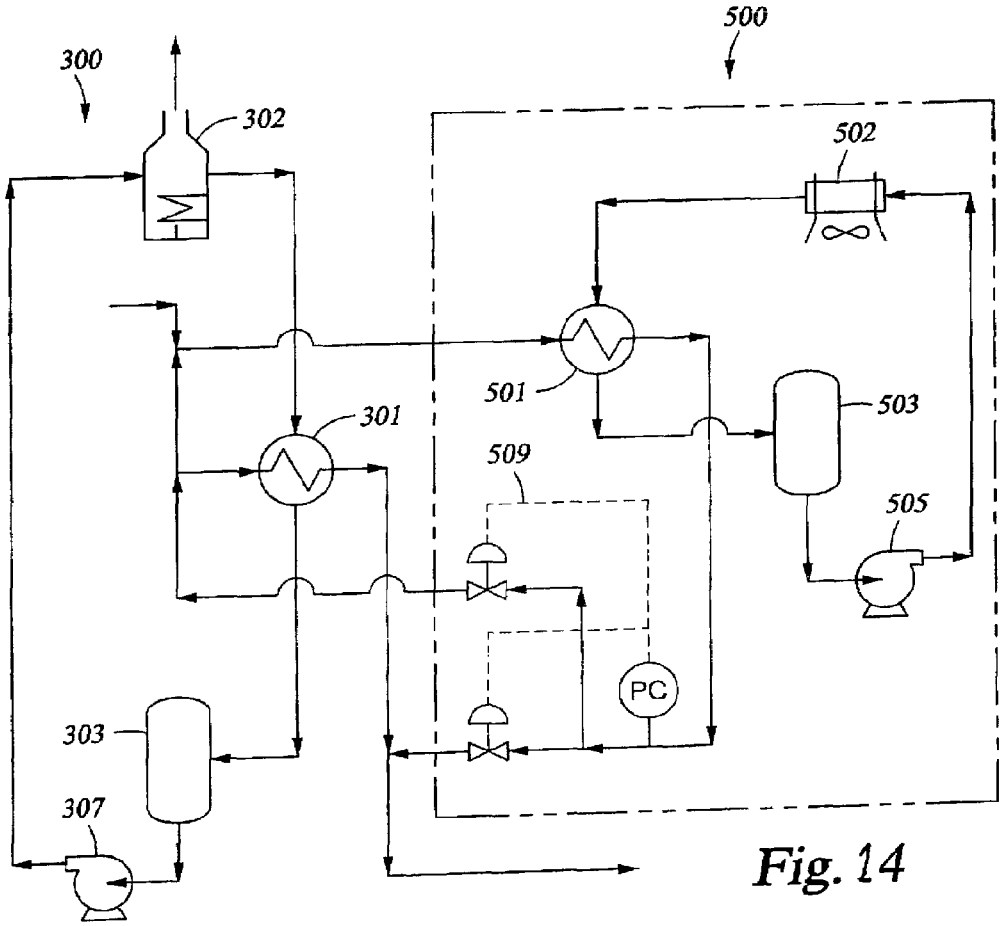

For example, the typical ethylene glycol/water system shown in FIG. 13 and modified/retrofitted by the addition of air pre-heater 315, may instead be modified/retrofitted as shown in FIG. 14 by the addition of system 500 in which a heat transfer fluid is circulated in a closed circuit via pump 505 through air heater 502 where it is heated, through exchanger 501 where it heats LNG, through accumulator 503, and back to heater 502 to complete the circuit. Controller 509 regulates flow of LNG to the pipeline and/or back to the LNG Vaporizer.

Figure 17:
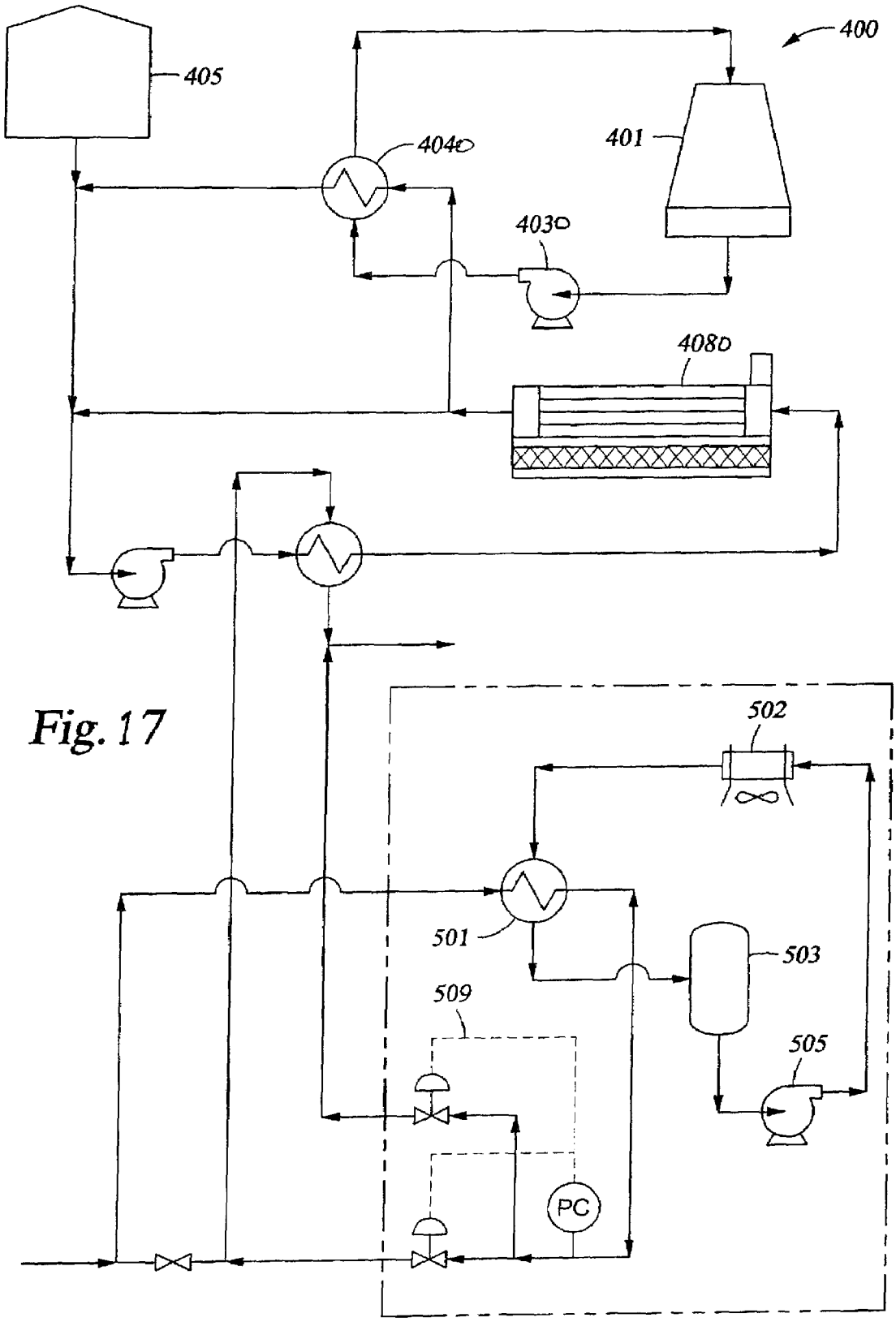

As another example, the typical cooling tower vaporization system shown in FIG. 16 and modified/retrofitted by the addition of air exchanger 415, may instead be modified/retrofitted as shown in FIG. 17 by the addition of system 500 in which a heat transfer fluid is circulated in a closed circuit via pump 505 through air heater 502 where it is heated, through exchanger 501 where it heats LNG, through accumulator 503, and back to heater 502 to complete the circuit. Controller 509 regulates flow of LNG to the pipeline and/or back to the LNG Vaporizer.

Figure 15:
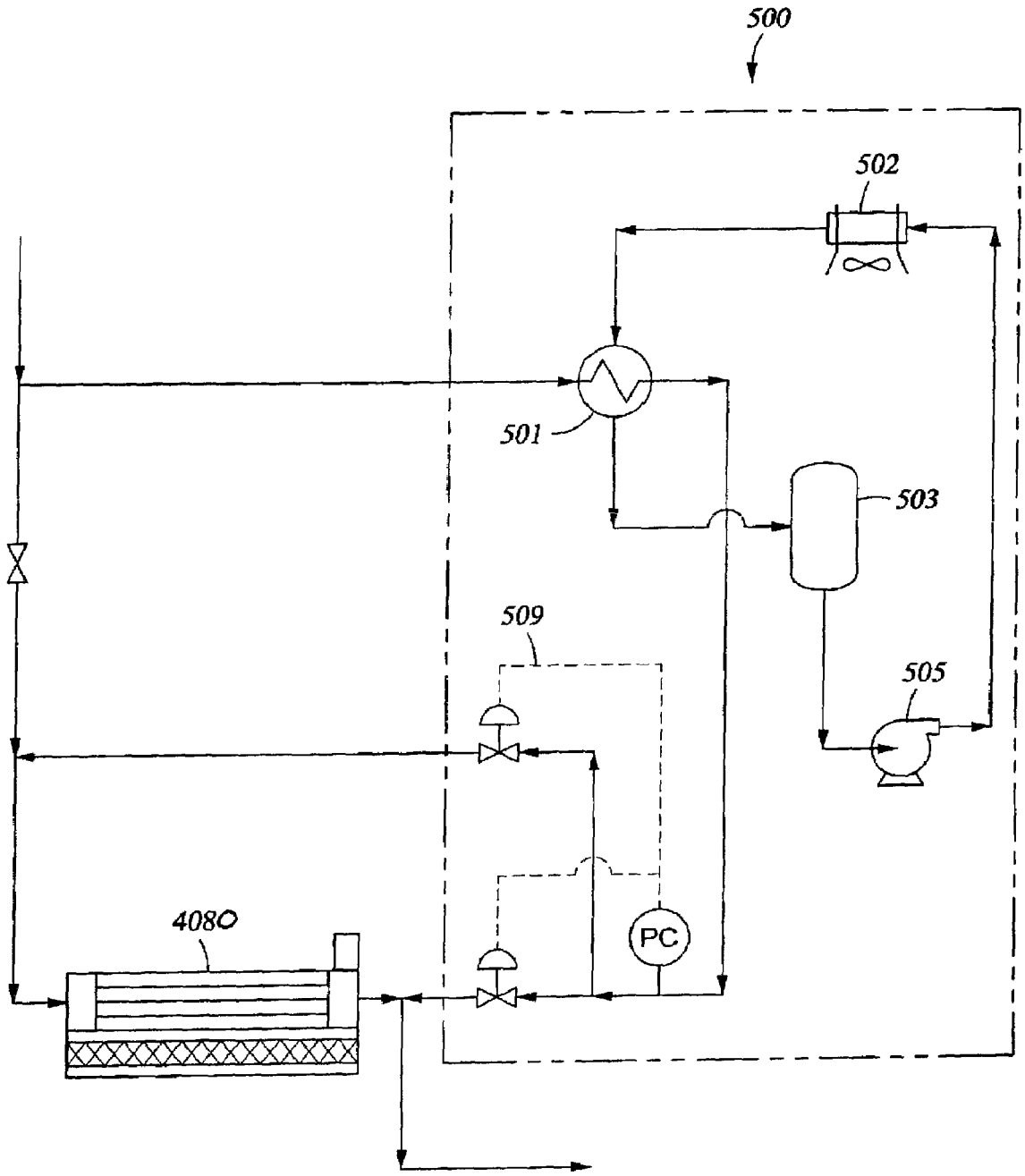
FIG. 15 is a schematic showing a retrofit of a water bath or submerged combustion system.

FIG. 15 is a schematic showing the retrofit of a water bath or submerged combustion vaporizer by the addition of system 500 as described above.

Figure 18:
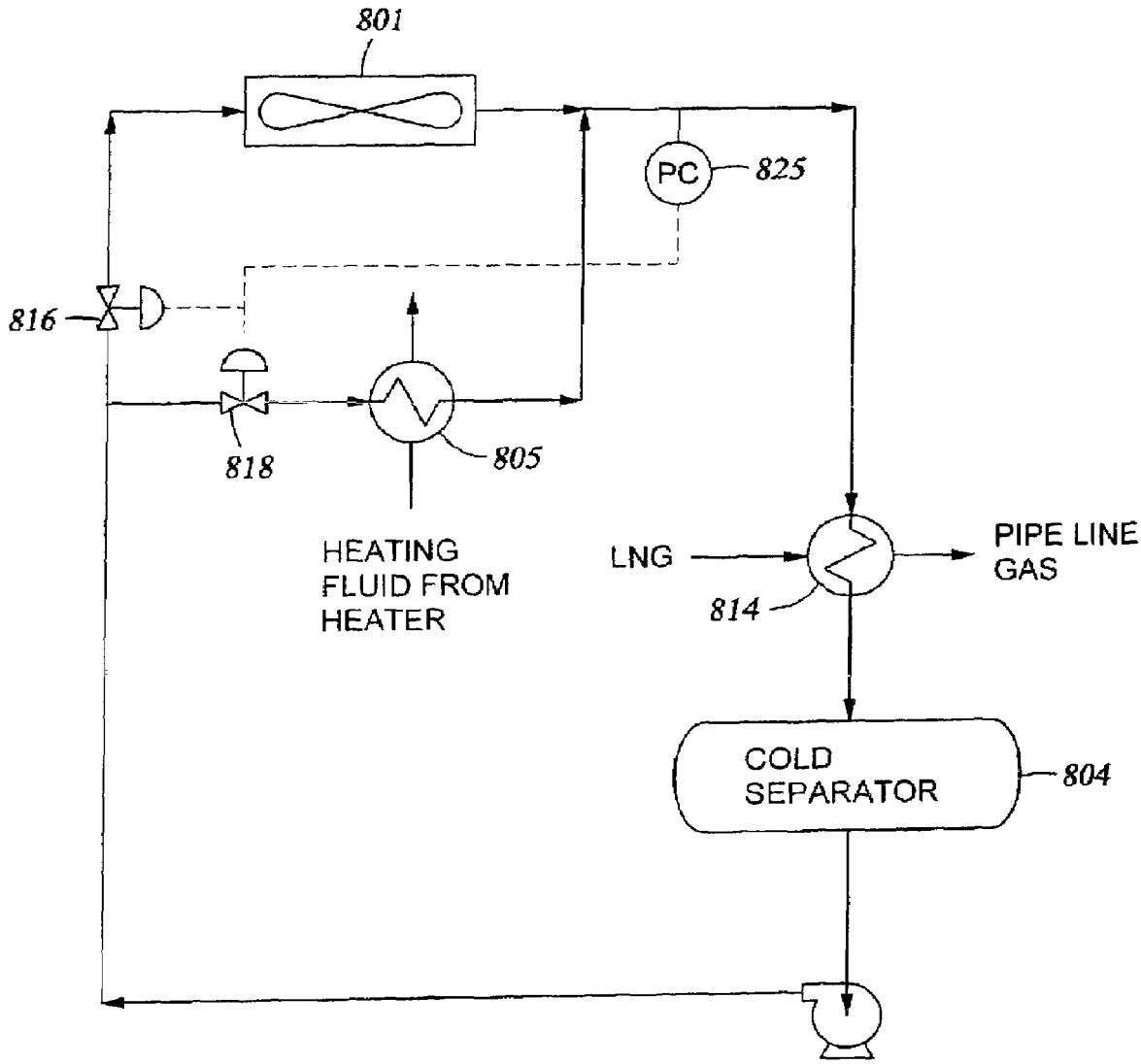
FIG. 18 is a process flow schematic showing a vaporization process.

Another non-limiting embodiment of the apparatus and methods of the present invention is best described by reference to FIG. 18, which is a process flow schematic showing vaporization process system 800 having air exchange pre-heater 801, accumulator 804, auxiliary heater 805, vaporizer 814, air exchange feeder line valve 816, heater feeder line valve 818 and temperature controller 825.

In this embodiment, temperature controller 825 monitors the temperature of the heat transfer fluid. If the temperature of the heat transfer fluid is not sufficiently high, then controller 825 operates valves 816 and 818 to achieve a desired heat transfer fluid temperature, by utilizing pre-heater 801, auxiliary heater 805, or a combination thereof with the heating duty shared between heaters 801 and 805 in any suitable ratio. Controller 825 can be equipped with suitable algorithms in the form of either software and/or hardware to carry out this temperature control.

Figure 19:
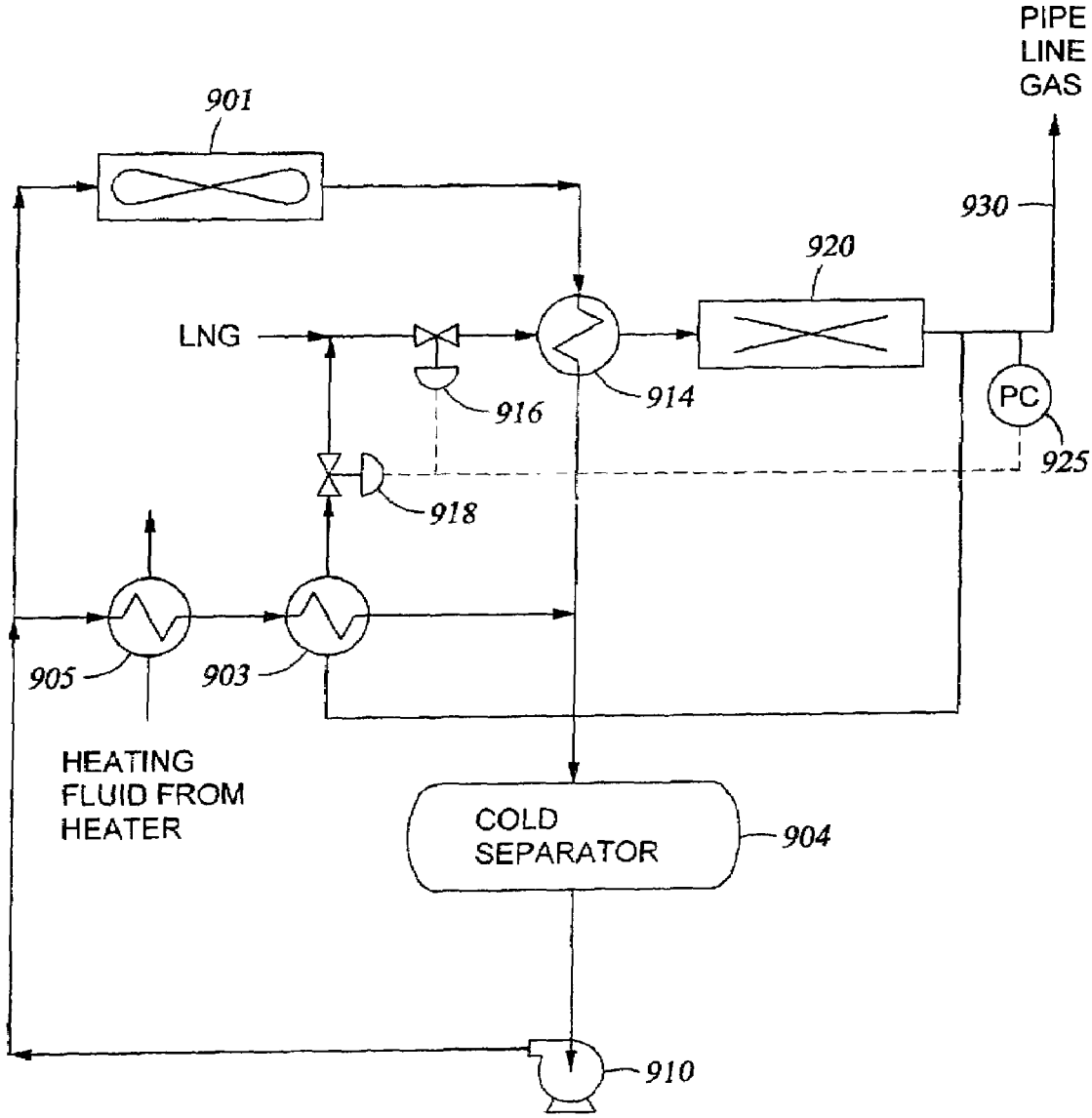
FIG. 19 is a process flow schematic showing a vaporization process system.

Another embodiment of the present invention is shown in FIG. 19, which is a process flow schematic showing vaporization process system 900 having air exchange pre-heater 901, auxiliary heater vaporizer 903, cold separator 904, auxiliary heater 905, second fluid pump 910, pre-heater vaporizer 914, pre-heater vaporizer LNG feed valve 916, auxiliary heater vaporizer LNG feed valve 918, second air exchange heater 920 and temperature controller 925.

This embodiment contains a pair of vaporizers in which vaporizer 903 receives heat transfer liquid from heater 905 and the other vaporizer 914 receives heat from heater 901. Temperature controller 925 monitors the temperature of gas 930 and operates valves 916 and 918 according to an algorithm to achieve the desired temperature of gas 930. The vaporization load is carried by the auxiliary heater vaporizer 903 and pre-heater vaporizer 914, or a combination thereof with the vaporization load shared between vaporizers 903 and 914 in any suitable ratio.

It should be understood that any of the above systems may incorporate process controls/methods as are known to those of skill in the art. For example, by-passes around any of the heat exchanges may be utilized. It should also be understood that much of the engineering/process detail is not shown in the above illustrations but would be well within the knowledge and understanding of those of skill in the art.

VAPORIZATION EXAMPLES

The following non-limiting examples are provided merely to illustrate a few embodiments of a the vaporization process of the present invention, and these examples are not meant to and do not limit the scope of the claims of the present invention. These are theoretical calculated examples.

Example 1

This example utilizes the apparatus and method as shown in FIG. 11 (11 at −10 F, 31 at 50 F, 32 at −10 F, and 119 at 16 psig). The cryogenic fluid is a typical LNG. The circulating fluid utilized is propane. The duty percentage for the air cooler 101, and the combined duty percentage for fired heater 105 and economizer 103 were calculated for ambient air temperatures of 35 F, 45 F, 65 F, 70 F and 85 F, with these percentages presented in the following TABLE 3. The propane circulation is about 1.7 lb propane/lb LNG, with the rate depending upon the temperature and pressure of the LNG and propane. The propane circulation range is estimated to be from about 1.0 to 2.5 lb propane/lb LNG.

TABLE 3

Duty Percentage at Various Ambient Air Temperatures

| | 85 F. | 70 F. | 65 F. | 45 F. | 35 F. |
|---|---|---|---|---|---|
| Air Cooler | 100 | 100 | 95 | 70 | 58 |
| Fired Heat/Economizer | 0 | 0 | 5 | 30 | 42 |
| Total | 100 | 100 | 100 | 100 | 100 |

Example 2

This example also utilizes the apparatus and method as shown in FIG. 1 (11 @−10 F, 31 @50 F, 32 @−10 F, and 119 at 100 psig). The cryogenic fluid is again a typical LNG. The circulating fluid utilized is propane. The duty percentage for the air cooler 101, and the combined duty percentage for fired heater 105 and economizer 103 were calculated for ambient air temperatures of 35 F, 45 F, 65 F, 70 F and 85 F, with these percentages presented in the following TABLE 4. The propane circulation is about 7.6 lb propane/lb LNG, with the rate depending upon the temperature and pressure of the LNG and propane. The propane circulation range is estimated to be from about 5.0 to 10.0 lb propane/lb LNG.

TABLE 4

Duty Percentage at Various Ambient Air Temperatures

| | 85 F. | 70 F. | 65 F. | 45 F. | 35 F. |
|---|---|---|---|---|---|
| Air Cooler | 100 | 100 | 93 | 57 | 47 |
| Fired Heat/Economizer | 0 | 0 | 7 | 43 | 53 |
| Total | 100 | 100 | 100 | 100 | 100 |

Example 3

This example again utilizes the apparatus and method as shown in FIG. 11 (11 at range of −10 F to 30 F, 30 at −10 F, 31 at 50 F, 32 at 30 F, and 119 at 16 psig). The cryogenic fluid is a typical LNG. Rather than using propane as the circulating fluid, WBF is utilized. As with Examples 1 and 2, the duty percentage for the air cooler 101, and the combined duty percentage for fired heater 105 and economizer 103 were calculated for ambient air temperatures of 35 F, 45 F, 65 F, 70 F and 85 F, with these percentages presented in the following TABLE 5. The WBF circulation is about 10-30 lb WBF/lb LNG, with the rate depending upon the temperature and pressure of the LNG and propane.

TABLE 5

| Duty Percentage at Various Ambient Air Temperatures | | | | | |
|---|---|---|---|---|---|
| | 85 F. | 70 F. | 65 F. | 45 F. | 35 F. |
| Air Cooler | 100 | 100 | 93 | 60 | 51 |
| Fired Heat/Economizer | 0 | 0 | 7 | 40 | 49 |
| Total | 100 | 100 | 100 | 100 | 100 |

Example 4

Figure 12:
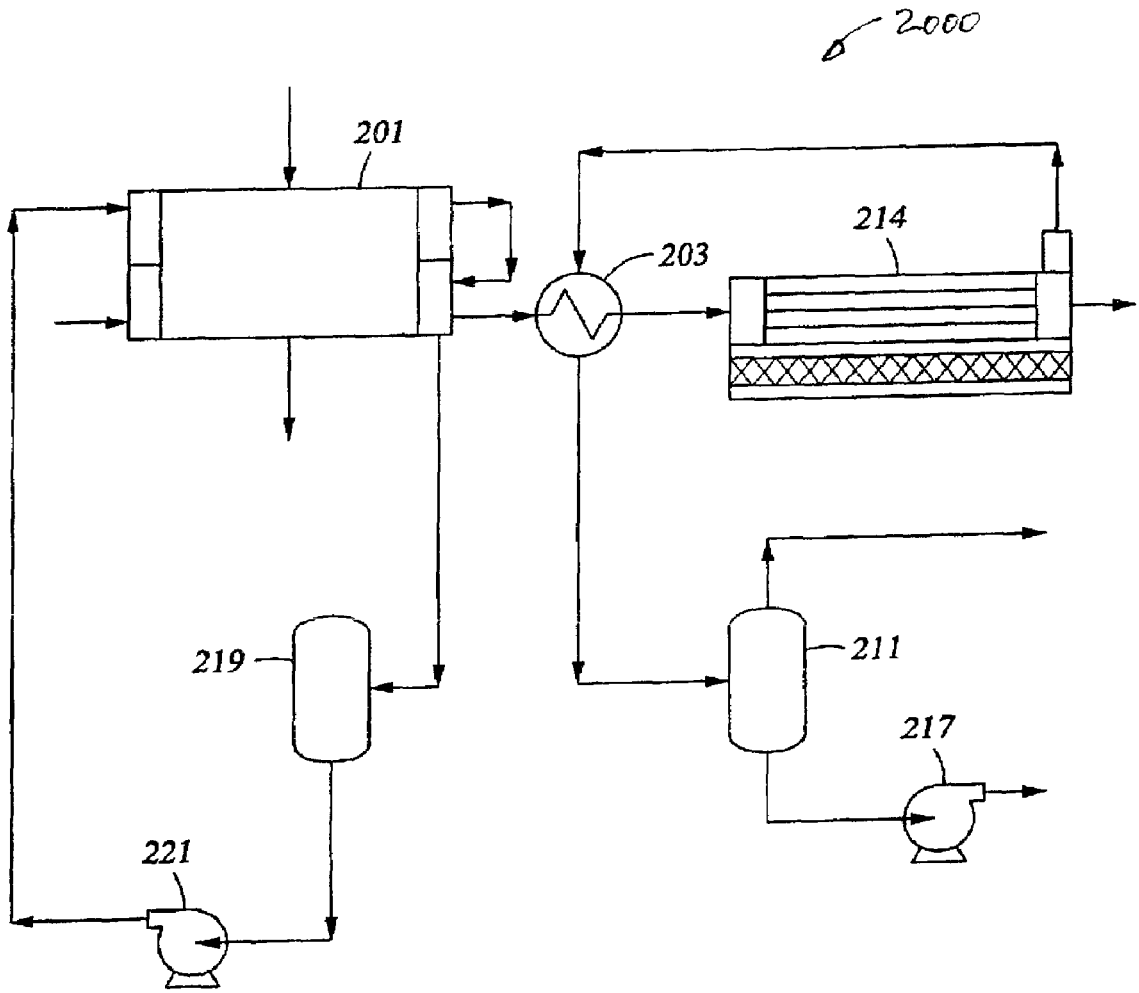
FIG. 12 is a process flow schematic showing another regasification system.

This example utilizes the apparatus and method as shown in FIG. 12. The cryogenic fluid is a typical LNG. The warming medium utilized is propane. The duty percentage for the tube-in-tube air exchange 201, and the combined duty percentage for fired heater 214 and economizer 203 were calculated for ambient air temperatures of 35 F, 45 F, 65 F, 70 F and 85 F, with these percentages presented in the following TABLE 6. The economizer is used with the Water Bath Heater only.

TABLE 6

| Duty Percentage at Various Ambient Air Temperatures | | | | | |
|---|---|---|---|---|---|
| | 85 F. | 70 F. | 65 F. | 45 F. | 35 F. |
| Air Cooler | 100 | 100 | 93 | 57 | 47 |
| Fired Heat/Economizer | 0 | 0 | 5 | 43 | 53 |
| Total | 100 | 100 | 100 | 100 | 100 |

Example 5

Potential savings utilizing present invention.

Basis: 1000 MMBtu/Hr; Air exchanger designed assuming 70 F; $5.00/MMBtu; 365 days of operation/yr.

| | Month: | | | | | | | | | | | |
|---|---|---|---|---|---|---|---|---|---|---|---|---|
| | January | February | March | April | May | June | July | August | September | October | November | December |
| T (F.): | 51 | 54 | 61 | 67 | 75 | 81 | 82 | 83 | 79 | 70 | 61 | 55 |
| AIR Htr % Duty: | 77.5 | 81 | 90 | 94 | 100 | 100 | 100 | 100 | 100 | 100 | 90 | 80 |
| Air Duty (MMBtu/Hr): | 775 | 810 | 900 | 940 | 1000 | 1000 | 1000 | 1000 | 1000 | 1000 | 900 | 800 |

Average Yearly Savings: 927.1×$5×24×365=$40.6 MM/Yr.

The above calculations are based on approximately 1500 MMSCFD being vaporized.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. An apparatus comprising:

a floating liquefaction unit comprising a first docking system;

a floating regasification unit comprising a second docking system; and, a shuttle vessel comprising a cryogenic storage system and a third docking system, wherein the shuttle vessel may be docked with the liquefaction unit, docked with the gassification unit, or traveling between the liquefaction unit and the regasification unit, and wherein the third docking system is connectable with the first docking system to allow transfer of a liquified liquefied gas from the liquefaction unit into the cryogenic storage system when the vessel is docked with the liquefaction unit, and connectable with the second docking system to allow transfer of a liquefied gas from the cryogenic storage unit to the gasification unit when the vessel is docked with the gassification unit; wherein the cryogenic storage system comprises:

a sealed containment box;

a multiplicity of tanks positioned within the box;

a pump system positioned within the box and in liquid communication with the tanks; and a vaporizer positioned outside the box and in liquid communication with the pump system.

2. The apparatus of claim 1, wherein the floating liquefaction unit is connected to a gas source, and the floating regasification unit is connected to a gas distribution system.

3. The apparatus of claim 2, wherein the liquefaction unit, the gassification unit, and the vessel are all floating on a body of water.

4. A method of transporting a gas, comprising;

(A) receiving the gas into a floating liquefaction unit, (B) liquifying the gas to form a liquefied gas;

(C) transferring the liquefied gas from the liquefaction unit into a cryogenic storage unit of a marine vessel, wherein the cryogenic storage unit comprises a sealed containment box;

a multiplicity of tanks positioned within the box;

a pump system positioned within the box and in liquid communication with the tanks; and a vaporizer positioned outside the box and in liquid communication with the pump system;

(D) transferring the liquefied gas from the marine vessel into a floating regasification unit; and (E) regasifying the liquefied gas into a regasified gas.

5. The method of claim 4, wherein the gas of step (A) is from a gas pipeline, a well, mobile vessel, or a storage tank.

* * * * *